US010941501B2

(12) United States Patent
Eidschun et al.

(10) Patent No.: US 10,941,501 B2
(45) Date of Patent: Mar. 9, 2021

(54) METHOD AND COMPOSITION FOR METAL FINISHING

(71) Applicant: Analytical Specialties, Inc., Clearwater, FL (US)

(72) Inventors: Keith E. Eidschun, Clearwater, FL (US); Joshua Cloakey, Clearwater, FL (US)

(73) Assignee: Analytical Specialties, Inc., Clearwater, FL (US)

( * ) Notice: Subject to any disclaimer, the term of this patent is extended or adjusted under 35 U.S.C. 154(b) by 887 days.

(21) Appl. No.: 14/230,895

(22) Filed: Mar. 31, 2014

(65) Prior Publication Data

US 2016/0319452 A1 Nov. 3, 2016

Related U.S. Application Data

(60) Provisional application No. 61/806,618, filed on Mar. 29, 2013.

(51) Int. Cl.
*C25D 11/02* (2006.01)
*C25D 11/04* (2006.01)
(Continued)

(52) U.S. Cl.
CPC ..... *C25D 11/02* (2013.01); *C23C 18/1689* (2013.01); *C23C 18/1834* (2013.01);
(Continued)

(58) Field of Classification Search
CPC ..... C25D 11/04–246; C25D 11/02–34; C25D 11/30
See application file for complete search history.

(56) References Cited

U.S. PATENT DOCUMENTS 2,231,373 A * 2/1941 Schenk ..... C25D 11/06 205/175
3,496,076 A * 2/1970 Cheseldine ..... C25D 11/26 205/171
(Continued)

FOREIGN PATENT DOCUMENTS

GB 329190 * 5/1930
GB 396743 * 8/1933
(Continued)

OTHER PUBLICATIONS

Mohammadi et al., Corrosion behavior of 2024 aluminum alloy anodized in presence of permanganate and phosphate ions, 10 (2) J. Coat. Tech. Res. 219 (first online 2012, 2013).*
(Continued)

*Primary Examiner* — Brian W Cohen
*Assistant Examiner* — Ho-Sung Chung
(74) *Attorney, Agent, or Firm* — Michele L. Lawson; Smith & Hopen, P.A.

(57) ABSTRACT

The present invention describes a composition and method to control dimensional growth during an anodizing process. Potassium permanganate has been discovered, when added to an anodizing solution containing at least one acid, to minimize dimensional change. This novel composition and method were found to be safer, quicker and less expensive than the conventional method of anodizing aluminum. In addition, the novel composition and method were found to have superior properties to aluminum anodized by the conventional method with respect to durability and corrosion resistance. In addition to anodizing, the novel solution described herein is capable of several other uses including the removal of organic and metal contaminants from solution, producing black electroless nickel on a substrate, producing a bright nickel coating on a substrate such as
(Continued)

aluminum, and cleaning and activating aluminum for plating.

5 Claims, 17 Drawing Sheets

(51) Int. Cl.

| | |
|---|---|
| ***C25D 11/06*** | (2006.01) |
| ***C25D 11/16*** | (2006.01) |
| ***C25D 5/48*** | (2006.01) |
| ***C23C 18/16*** | (2006.01) |
| ***C25D 5/12*** | (2006.01) |
| ***C23C 18/32*** | (2006.01) |
| ***C23C 18/18*** | (2006.01) |

(52) U.S. Cl.
CPC ..... *C23C 18/1848* (2013.01); *C23C 18/32* (2013.01); *C25D 5/12* (2013.01); *C25D 5/48* (2013.01); *C25D 11/04* (2013.01); *C25D 11/06* (2013.01); *C25D 11/16* (2013.01)

(56) References Cited

U.S. PATENT DOCUMENTS

| | | | | |
|---|---|---|---|---|
| 3,749,596 | A | 7/1973 | Yoshimura | |
| 3,920,413 | A | 11/1975 | Lowery | |
| 4,059,494 | A * | 11/1977 | Yanagida | C25D 11/22 204/206 |
| 4,744,872 | A | 5/1988 | Kobayashi et al. | |
| 5,358,623 | A | 10/1994 | Bibber | |
| 5,554,231 | A | 9/1996 | Bibber | |
| 7,175,676 | B1 | 2/2007 | Stevens et al. | |
| 2003/0070935 | A1 * | 4/2003 | Dolan | C25D 11/06 205/321 |
| 2003/0075453 | A1 | 4/2003 | Dolan | |
| 2003/0164350 | A1 * | 9/2003 | Hanson | H01J 9/20 216/2 |
| 2005/0106403 | A1 * | 5/2005 | Yui | B32B 15/04 428/469 |
| 2006/0049141 | A1 * | 3/2006 | Lai | B44C 1/227 216/83 |
| 2006/0141751 | A1 * | 6/2006 | Liao | C25D 11/32 438/466 |
| 2007/0158197 | A1 * | 7/2007 | Wang | C25D 9/08 205/50 |
| 2008/0149492 | A1 * | 6/2008 | Lin | C25D 11/02 205/206 |
| 2009/0301894 | A1 * | 12/2009 | Ehlers | C23C 18/165 205/170 |
| 2011/0171600 | A1 * | 7/2011 | Yang | A61C 8/0015 433/174 |
| 2011/0303545 | A1 | 12/2011 | Kim et al. | |

FOREIGN PATENT DOCUMENTS

| | | | | |
|---|---|---|---|---|
| GB | 416608 | * | 9/1934 | |
| JP | S61-235596 | * | 10/1986 | C25D 11/06 |
| JP | 2001348698 A | | 12/2001 | |
| WO | 2012083082 A1 | | 6/2012 | |

OTHER PUBLICATIONS

Mettler Toledo, Sulfuric Acid (2012).*
Wang, Analytical Electrochemistry 90 (2006).*
Mettler Toledo, Potassium Permanganate (2017).*
Egan and Luff, Density of Aqueous solutions of Phosphoric Acid, 47(6) Industrial and Eng. Chem. 1280 (1955).*
Takatani abstract and machine translation, JP S61-235596 (1986).*
Takatani, Partial Human Translation, JP S61-235596 A. (Year: 1986).*
Ali Yazdani, Mohammad Ebrahim Bahrololoom, Effect of potassium permanganate on corrosion performance of the anodized coating on 2024-T3 aluminum alloy, Iranian Journal of Surface and Engineering, No. 14, 2012, abstract.
International Search Report for International Patent No. PCT/US2014/039774, filing date of May 28, 2014, dated Dec. 18, 2014. English machine translation of JP 2001-348698.
International Preliminary Report on Patentability for PCT/US2014/039774 (filing date: May 28, 2014) with a priority dated Mar. 31, 2014; Applicant: Analytical Specialties, Inc. et al.

* cited by examiner

| Conventional Anodizing (10% v/v Sulfuric Acid) | | | | |
|---|---|---|---|---|
| Material | Starting thickness (inches) | Ending thickness (inches) | Dimensional Growth per side (inches) | oxide thickness per side (inches) |
| 2024 | 0.0321 | 0.0326 | 0.00025 | 0.00050 |
| 6061 | 0.0371 | 0.0376 | 0.00025 | 0.00050 |
| 7075 | 0.0347 | 0.0352 | 0.00025 | 0.00050 |

Figure 1

| Conventional Anodizing With Permanganate (10% v/v Sulfuric Acid and 0.2 % v/v 1.0M Potassium Permanganae | | | | |
|---|---|---|---|---|
| Material | Starting thickness (inches) | Ending thickness (inches) | Dimensional Growth per side (inches) | oxide thickness per side (inches) |
| 2024 | 0.0218 | 0.0219 | 0.00005 | 0.00050 |
| 6061 | 0.0374 | 0.0375 | 0.00005 | 0.00050 |
| 7075 | 0.0351 | 0.0352 | 0.00005 | 0.00050 |

Figure 2

2024 Aluminum

| Panel # | Starting thickness (inches) | Ending thickness (inches) | Dimensional Change Per Side (inches) | Oxide Formation Per Side (inches) |
|---|---|---|---|---|
| 1 | 0.0305 | 0.0305 | 0.00000 | 0.0001 |
| 2 | 0.0301 | 0.0301 | 0.00000 | 0.0002 |
| 3 | 0.0295 | 0.0295 | 0.00000 | 0.0003 |
| 4 | 0.0297 | 0.0297 | 0.00000 | 0.0004 |
| 5 | 0.0298 | 0.0299 | 0.00005 | 0.0005 |
| 6 | 0.0301 | 0.0302 | 0.00005 | 0.0007 |

Figure 3

6061 Aluminum

| Panel # | Starting thickness (inches) | Ending thickness (inches) | Dimensional Change Per Side (inches) | Oxide Formation Per Side (inches) |
|---|---|---|---|---|
| 1 | 0.0375 | 0.0375 | 0.00000 | 0.0001 |
| 2 | 0.0371 | 0.0371 | 0.00000 | 0.0002 |
| 3 | 0.0374 | 0.0374 | 0.00000 | 0.0003 |
| 4 | 0.0378 | 0.0379 | 0.00005 | 0.0004 |
| 5 | 0.0374 | 0.0375 | 0.00005 | 0.0005 |
| 6 | 0.0375 | 0.0376 | 0.00005 | 0.0007 |

Figure 4

7075 Aluminum

| Panel # | Starting thickness (inches) | Ending thickness (inches) | Dimensional Change Per Side (inches) | Oxide Formation Per Side (inches) |
|---|---|---|---|---|
| 1 | 0.0351 | 0.0351 | 0.00000 | 0.0001 |
| 2 | 0.0345 | 0.0345 | 0.00000 | 0.0002 |
| 3 | 0.0355 | 0.0355 | 0.00000 | 0.0003 |
| 4 | 0.0347 | 0.0347 | 0.00000 | 0.0004 |
| 5 | 0.0351 | 0.0352 | 0.00005 | 0.0005 |
| 6 | 0.0347 | 0.0348 | 0.00005 | 0.0007 |

Figure 5

| Average Time | Average oxide thickness |
|---|---|
| 3 | 0.0001 |
| 8 | 0.0002 |
| 12 | 0.0003 |
| 17 | 0.0004 |
| 23 | 0.0005 |
| 30 | 0.0007 |

Figure 6

| Panel # | Material | Thickness 1 | Thickness 2 | ΔThickness | Aluminum Oxide Formation per Side | Volts | Amps | Time | Temperature Beginning (°F) | Temperature End (°F) | Component (g/L) |
|---|---|---|---|---|---|---|---|---|---|---|---|
| 1 | 6061 | 0.0305 | 0.0307 | 0.0002 | 0.00021 | 15 | 1 | 15 | 60 | 63 | 0 |
| 2 | 6061 | 0.0305 | 0.0305 | 0.0000 | 0.00018 | 15 | 1.334 | 15 | 59 | 61 | 0.08 |
| 3 | 2024 | 0.0346 | 0.0347 | 0.0001 | 0.00048 | 15 | 1.422 | 30 | 60 | 62 | 0.08 |
| 4 | 7075 | 0.0395 | 0.0395 | 0.0000 | 0.00041 | 15 | 1.267 | 30 | 61 | 64 | 0.08 |

Figure 7

| Specimen | Material | Thickness 1 | Thickness 2 | Anodic Thickness | Dimensional Growth | Percent Growth |
|---|---|---|---|---|---|---|
| 1 | 6061 | 0.0305 | 0.0306 | 0.0006 | 0.00005 | 8.33 |
| 2 | 6061 | 0.0305 | 0.0305 | 0.0003 | 0.00000 | 0.00 |
| 3 | 2024 | 0.0345 | 0.0346 | 0.0005 | 0.00005 | 10.00 |
| 4 | 2024 | 0.0345 | 0.0345 | 0.0003 | 0.00000 | 0.00 |
| 5 | 7075 | 0.0395 | 0.0396 | 0.0005 | 0.00005 | 10.00 |
| 6 | 7075 | 0.0395 | 0.0395 | 0.0003 | 0.00000 | 0.00 |

Figure 8

| Panel | Starting Thickness (inches) | Ending Thickness (inches) | Anodic Coating Thickness (inches) | Starting Weight (g) | Ending Weight (g) |
|---|---|---|---|---|---|
| 1 | 0.0320 | 0.0320 | 0.0005 | 12.3640 | 12.4763 |
| 2 | 0.0318 | 0.0318 | 0.0005 | 12.3279 | 12.4392 |
| 3 | 0.0321 | 0.0321 | 0.0004 | 12.3924 | 12.5016 |
| 4 | 0.0318 | 0.0319 | 0.0005 | 12.2462 | 12.3697 |

Figure 9

| ID | Material | L (Inches) | W (Inches) | Start T (Inches) | End T (Inches) | Anodic Thickness (Inches) | Results |
|---|---|---|---|---|---|---|---|
| 11520141 | 6061 | 10 | 3 | 0.0302 | 0.0302 | 0.00030 | 800hrs |
| 11520142 | 6061 | 10 | 3 | 0.0303 | 0.0303 | 0.00030 | 800hrs |
| 11520143 | 6061 | 10 | 3 | 0.0306 | 0.0306 | 0.00030 | 800hrs |
| 11520144 | 6061 | 10 | 3 | 0.0306 | 0.0306 | 0.00030 | 800hrs |
| 11520145 | 6061 | 10 | 3 | 0.0303 | 0.0303 | 0.00030 | 800hrs |

Figure 12

| ID | Material | L (Inches) | W (Inches) | Start T (Inches) | End T (Inches) | Anodic Thickness (Inches) | Results |
|---|---|---|---|---|---|---|---|
| 11620141 | 6061 | 4 | 4 | 0.0315 | 0.0316 | 0.00080 | 0.9,1.1 |
| 11620142 | 6061 | 4 | 4 | 0.0316 | 0.0317 | 0.00120 | 1.0 |

Figure 13

| ID | Material | L (Inches) | W (Inches) | Start T (Inches) | End T (Inches) | Anodic Thickness (Inches) | Coating Weight (mg/ft$^2$) |
|---|---|---|---|---|---|---|---|
| 115201410 | 6061 | 6 | 4 | 0.0319 | 0.0319 | 0.00037 | 2636.1 |
| 115201411 | 6061 | 6 | 4 | 0.0317 | 0.0317 | 0.00037 | 2700.6 |
| 115201412 | 6061 | 6 | 4 | 0.0313 | 0.0313 | 0.00038 | 2420.7 |
| 115201413 | 6061 | 6 | 4 | 0.0316 | 0.0316 | 0.00037 | 2793.3 |
| 115201414 | 6061 | 6 | 4 | 0.0317 | 0.0317 | 0.00037 | 2646.9 |

| ID | Material | L (Inches) | W (Inches) | Start T (Inches) | End T (Inches) | Anodic Thickness (Inches) | Results |
|---|---|---|---|---|---|---|---|
| 11520146 | 6061 | 3 | 3 | 0.0303 | 0.0303 | 0.00042 | 0.0004 |
| Standard | 6061 | 3 | 3 | - | - | 0.00061 | 0.0006 |

Figure 16

| ID | Material | L (Inches) | W (Inches) | Start T (Inches) | End T (Inches) | Anodic Thickness (Inches) | Results |
|---|---|---|---|---|---|---|---|
| 11520146 | 6061 | 10 | 3 | 0.0303 | 0.0303 | 0.00030 | Passed |

Figure 17

| ID | Material | L (Inches) | W (Inches) | Start T (Inches) | End T (Inches) | Anodic Thickness (Inches) | Results |
|---|---|---|---|---|---|---|---|
| 11520149 | 6061 | 6 | 4 | 0.0318 | 0.0318 | 0.00039 | See Figures 15-26 |
| 12820141 | 6061 | 6 | 4 | 0.0317 | 0.0318 | 0.00140 | See Figures 27-34 |

Figure 18

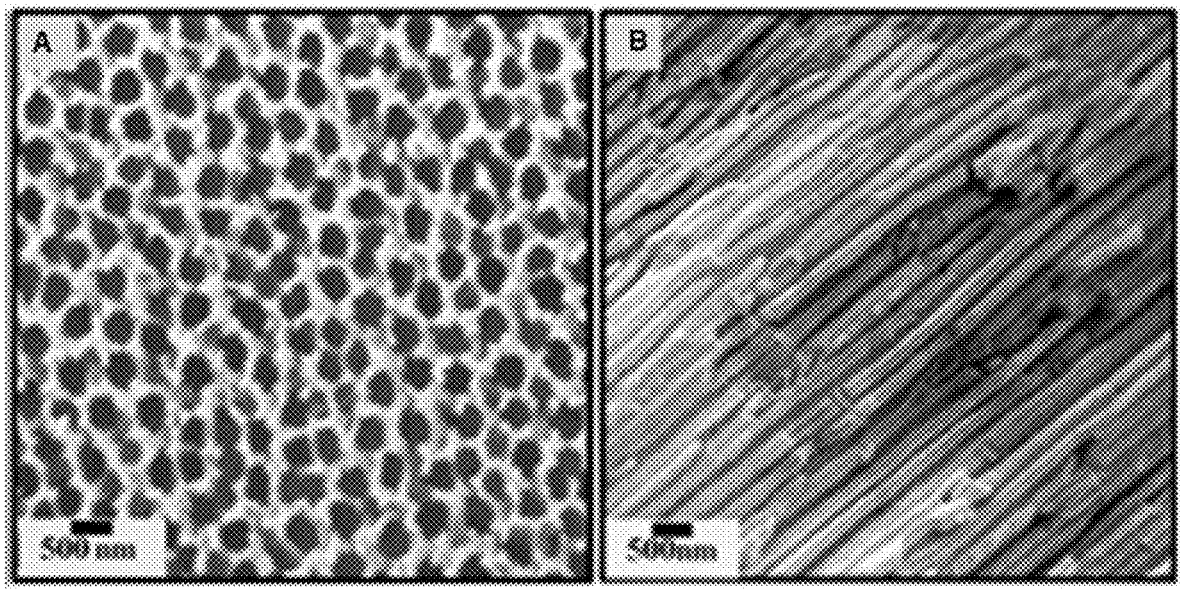
Figure 25A-B

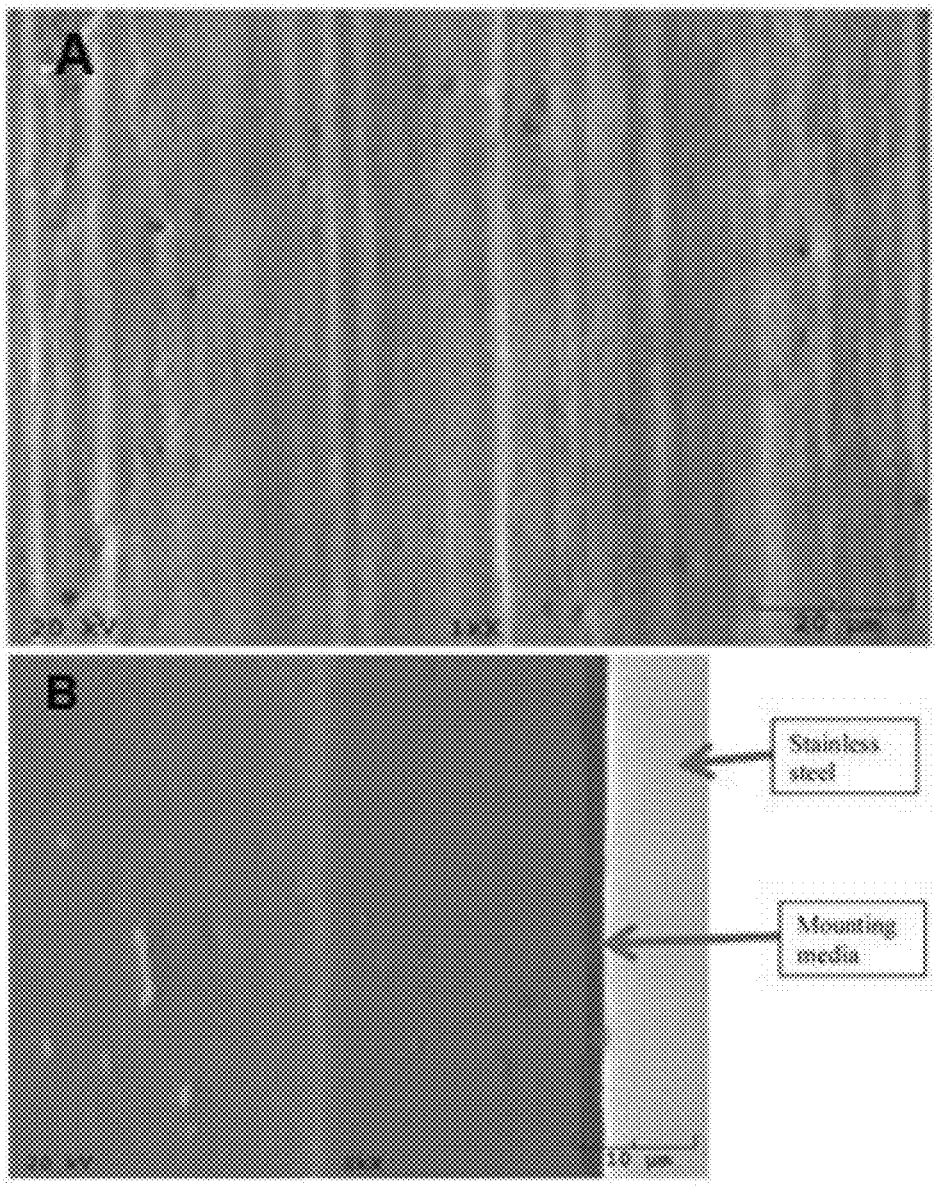
Figure 26A-B

METHOD AND COMPOSITION FOR METAL FINISHING

CROSS REFERENCE TO RELATED APPLICATIONS

This application is a nonprovisional of and claims priority to U.S. Provisional Application No. 61/806,618, entitled "Method and Composition for Metal Finishing", filed Mar. 29, 2013, the contents of which are herein incorporated by reference.

FIELD OF INVENTION

This invention relates to a method and composition for metal finishing. Specifically the composition is drawn to an anodizing solution and method for controlling dimensional growth during an anodizing process as well as other novel uses for the novel composition ranging from cleaning and activating aluminum for plating to the formation of black electroless nickel on a substrate.

BACKGROUND OF THE INVENTION

Anodizing generally refers to the process of building an oxide layer on a metal specimen in order to increase its durability and corrosion resistance. Light metals such as aluminum, magnesium, and titanium are generally used in the anodizing process. For example, aluminum has very little wear and corrosion resistance, while aluminum oxide has high corrosion and aluminum resistance. While aluminum naturally oxidizes, in order to build a sufficient oxidation layer a voltage is applied to force the formation of aluminum oxide. Due to the porous nature of aluminum, by forcing the formation of aluminum oxide, the oxide is built both onto the specimen as well as grown into the specimen. The growth to penetration ratio is about 50% of the total oxide formation.

The high current density area of the aluminum is at the base of the pore. When anodizing begins aluminum ions flow from the specimen into solution at the high current density areas of the pores, while oxide formation begins at the low current density areas of the pores. This property allows for the oxide formation to penetrate into the aluminum and also grow onto the aluminum thus changing the overall dimensions by 50% of the total oxide formation.

Various anodizing solutions are used in the industry to produce different oxide formations (pore structures). Sulfuric acid is the most common acid used in conventional anodization. Conventional sulfuric acid anodizing produces a pore that allows for dying while still providing wear and abrasion resistance. In conventional sulfuric acid anodizing, concentrations of sulfuric acid range from between about 8 to about 12 percent by volume sulfuric acid. The temperature of the solution generally ranges from about 60° F. to about 75° F. The amount of current used in conventional sulfuric acid anodizing is between about 18 to about 24 amps/ft$^2$.

Hard coat anodizing is a method of anodizing that produces pores similar to conventional anodizing but the oxide layer is very dense and the oxide formation is generally greater. Benefits of this are better wear and corrosion resistance, but it adds thickness and weight to the original specimen. Hard coat anodizing is typically done with a sulfuric acid anodizing solution having a higher concentration than that of conventional anodizing. The sulfuric acid concentration range for hard coat anodizing is between 16 to 20 percent by volume with the temperature ranging from 30° F. to 60° F. Much higher current is required to produce a hard coat, generally ranging between 30-40 amps/ft$^2$. There are industry solutions that can reduce the amount of current required to achieve the same product.

Chromic acid anodizing is another highly used anodizing method. It involves the use of chromium trioxide, or chromic acid, as the anodizing medium. This method allows for a very thin, very dense, compact layer of aluminum oxide to form. The aluminum oxide is mainly grown onto the specimen due to the high current required. This method of anodizing allows for minimal dimensional change while still provide sufficient wear and corrosion resistance. The oxide layer is very unsuitable for dyeing due to the nature of the pore structure. Drawbacks from this method are that chromic acid is a highly toxic chemical and is highly regulated both by the EPA as well as county regulations. Chromic acid anodizing is performed in about a 6-10 percent by weight solution of chromium trioxide at about 90-120° F. The current required for this process is about 20-60 VDC.

As shown above, the various types of anodizing do not allow for a thin oxide layer that does not add significantly to the dimensions of the light metal specimen and is capable of being dyed. What is needed is a composition and method that controls dimensional growth while still retaining dye capabilities as well as wear and corrosion resistant qualities.

SUMMARY OF INVENTION

It is an object of this invention to provide an environmentally friendly anodizing solution as well as a method of anodizing in which the specimen metal substantially retains its original dimensions while still providing the dye capabilities, wear resistance and corrosion resistance of conventional anodizing treatments.

The composition provided herein is a solution comprised of deionized water, at least one acid and at least one oxidizing agent. The acid used in the solution may be selected from sulfuric acid, nitric acid, phosphoric acid, hydrochloric acid, citric acid, boric acid, carboxylic acid, and carbonic acid. If sulfuric acid is used, the concentration may be between about 10% v/v to about 20% v/v.

The oxidizing agent used in the solution may be selected from potassium permanganate, sodium permanganate, lithium permanganate, hydrogen permanganate, ammonium persulfate, sodium persulfate, potassium persulfate, and sodium orthovanadate. If potassium permanganate is used, the concentration may be between about 0.01% v/v to about 10% v/v.

A method of anodizing to control dimensional growth is also presented. In the method, a solution containing deionized water; at least one acid such as sulfuric acid, nitric acid, phosphoric acid, hydrochloric acid, citric acid, boric acid, or carbonic acid or combinations thereof; and an oxidizing agent such as potassium permanganate, sodium permanganate, lithium permanganate, hydrogen permanganate, ammonium persulfate, sodium persulfate, potassium persulfate, or sodium orthovanadate is prepared. The solution is placed in a test plating cell and cooled. Once the solution is cooled, a light metal specimen is cleaned and placed in the solution in the test cell. A portable rectifier, having settings of between about 13 VDC and about 15 VDC with an average of 1.3 amps, is powered on to initiate the anodizing process. The panel remains in the solution with constant voltage for between about 20 to about 30 minutes. After this time, the current is turned off and the panel is removed from the solution, rinsed with deionized water and allowed to air dry.

The novel solution described herein is capable of many new uses besides anodizing including, but not limited to, the removal of organic and metal contaminants from solution, producing black electroless nickel on a substrate, producing a bright nickel coating on a substrate such as aluminum, and cleaning and activating aluminum for plating.

BRIEF DESCRIPTION OF THE DRAWINGS

For a fuller understanding of the invention, reference should be made to the following detailed description, taken in connection with the accompanying drawings, in which:

FIG. 1 is a table depicting the results of the initial testing of dimensional change using conventional anodizing at 10% w/v sulfuric acid. Starting and ending thickness of the specimen was measured with a micrometer. Starting and ending thickness of the oxide formation was measured with a Dualscope.

FIG. 2 is a table depicting the results of the initial testing of dimensional change using conventional anodizing with potassium permanganate added. Anodizing was carried out in 10% w/v sulfuric acid and 0.2% v/v of 1.0M potassium permanganate. The test to verify that the permanganate reacted per the theory was conducted from 65°-75° F. with 12 VDC and 22 amps/ft$^2$.

FIG. 3 is a table depicting the results of anodizing experiments conducted on 2024 aluminum. All test panels were run with 15V DC current and 1.3 amps. Temperature of the solution was between 60° F. and 75° F. Time varied according to the thickness that was required. Starting and ending thickness of the specimen was measured with a micrometer. Starting and ending thickness of the oxide formation was measured with a Dualscope.

FIG. 4 is a table depicting the results of anodizing experiments conducted on 6061 aluminum. All test panels were run with 15V DC current and 1.3 amps. Temperature of the solution was between 60° F. and 75° F. Time varied according to the thickness that was required. Starting and ending thickness of the specimen was measured with a micrometer. Starting and ending thickness of the oxide formation was measured with a Dualscope FIG. 5 is a table depicting the results of anodizing experiments conducted on 7075 aluminum. All test panels were run with 15V DC current and 1.3 amps. Temperature of the solution was between 60° F. and 75° F. Time varied according to the thickness that was required. Starting and ending thickness of the specimen was measured with a micrometer. Starting and ending thickness of the oxide formation was measured with a Dualscope.

FIG. 6 is a table depicting the average oxide thickness as a function of time. A fresh anodizing solution was used for each trial.

FIG. 7 is a table depicting the results of the small scale dimensional analysis.

FIG. 8 is a table depicting the results of the midscale dimensional analysis.

FIG. 9 is a table depicting anodic coating thickness, dimensional thickness, and weight.

FIG. 12 is a table depicting the results of the salt spray analysis. As shown in the table, the anodic coating described herein was able to withstand corrosion from exposure to salt spray for 800 hours as opposed to 336 hours for the prior art.

FIG. 13 is a table depicting the results of the taber abrasion analysis. As shown in the table, the anodic coating described herein, having less than half of the thickness of a conventional anodic coating, was able to withstand back to back taber abrasion tests.

FIG. 16 is a table depicting the results of the micrograph analysis.

FIG. 17 is a table depicting the results of the paint adhesion testing.

FIG. 18 is a table depicting the dimensions including anodic thickness for both of the samples tested. Sample ID No. 11520149 is also known as Sample 1 throughout this disclosure while Sample ID No. 12820141 is known as Sample 2 throughout this disclosure.

FIG. 25A-B are images depicting (A) topographic and (B) cross section of aluminum oxide coatings using the current standard anodizing solution. The porous nature of the coating and presence of microfractures can be seen in the images.

FIG. 26A-B are images depicting (A) topographic and (B) cross section of the novel aluminum oxide coating described herein. As shown in the images, the coating does not have a porous nature nor does it exhibit microfractures.

DETAILED DESCRIPTION OF THE PREFERRED EMBODIMENT

Figure 10:
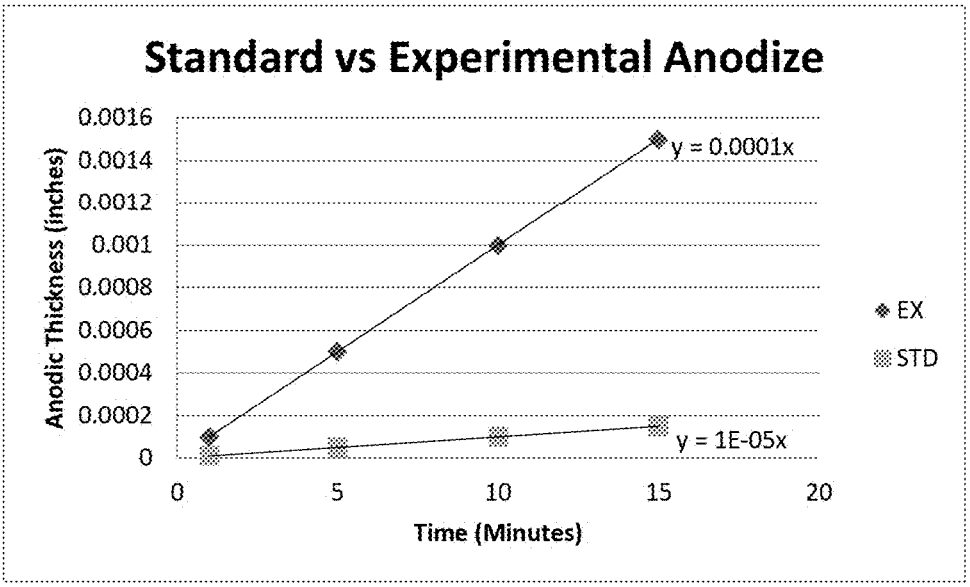
FIG. 10 is a graph comparing the conventional method of anodizing versus the method described herein with regard to anodic thickness as a function of time.

In the following detailed description of the preferred embodiments, reference is made to the accompanying drawings, which form a part hereof, and within which are shown by way of illustration specific embodiments by which the invention may be practiced. It is to be understood that other embodiments by which the invention may be practiced. It is to be understood that other embodiments may be utilized and structural changes may be made without departing from the scope of the invention.

All numerical designations, such as pH, temperature, time, concentration, and molecular weight, including ranges, are approximations which are varied up or down by increments of 1.0 or 0.1, as appropriate. In the event that the numerical designation is less than 0.1, the numerical designation may be varied up or down by an increment of 1 according to the particular numerical designation. For example, if the numerical designation is 0.0003 then it may be varied up or down by an increment of 0.0001. It is to be understood, even if it is not always explicitly stated that all numerical designations are preceded by the term "about". It is also to be understood, even if it is not always explicitly stated, that the reagents described herein are merely exemplary and that equivalents of such are known in the art and can be substituted for the reagents explicitly stated herein.

Concentrations, amounts, solubilities, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include the individual values and sub-ranges within the indicated range. Thus, included in this numerical range are individual values such as 2, 3, and 4 and sub-ranges such as from 1-3, from 2-4 and from 3-5, etc. This same principle applies to ranges reciting only one numerical value. Furthermore, such an interpretation should apply regardless of the range or the characteristics being described.

The term "about" as used herein is not intended to limit the scope of the invention but instead encompass the specified material, parameter or step as well as those that do not materially affect the basic and novel characteristics of the invention. The term "about" or "approximately" as used herein refers to being within an acceptable error range for the particular value as determined by one of ordinary skill in the art, which will depend in part on how the value is measured or determined, i.e. the limitations of the measurement system, i.e. the degree of precision required for a particular purpose. For example, "about" can mean within 1 standard deviation, per the practice in the art. Alternatively, "about" can mean a range of up to 20%, preferably up to 10%, more preferably up to 5% and more preferably still up to 1% of a given value. Alternatively, the term can mean within an order of magnitude, preferably within 5-fold, and more preferably within 2-fold, of a value. Where particular values are described in the application and claims, unless otherwise stated, the term "about" meaning within an acceptable error range for the particular value should be assumed.

As used in the specification and claims, the singular form "a", "an" and "the" includes plural references unless the context clearly dictates otherwise.

The term "oxidizing agent" as used herein refers to an element or compound that is capable of accepting an electron from another species in an oxidation-reduction reaction. Oxidizing agents used herein include, but are not limited to, sodium orthovanadate, sodium persulfate, ammonium persulfate, potassium persulfate, sodium permanganate, hydrogen permanganate and lithium permanganate. Many other oxidizers are contemplated by this invention; however it is preferable that the oxidizer is environmentally safe at the concentration used.

The term "substrate" as used herein refers to an object which is acted upon by the chemical reactions taking place in the methods described herein. The substrates used herein include, but are not limited to, most metals and metal alloys such as aluminum, steel, zinc, brass, and copper including all alloys of each.

The term "Cathode" as used herein refers to a metal substrate used as the cathodic electrode in the methods described herein. The cathodes used herein include, but are not limited to, metal alloys such as aluminum and all aluminum alloys, lead, stainless steel, and titanium, including all alloys of each.

An "electroless plating solution" as used herein refers to a solution which is capable of depositing a metal coating by a controlled chemical reduction that is catalyzed by the metal or alloy being deposited. The reaction is an autocatalytic reaction. An "electroless nickel plating solution" refers to the solution described previously in which the metal is nickel.

A "phosphorous electroless nickel coating" as used herein refers to the use of an electroless nickel solution (as defined above), containing both nickel and phosphorous, to coat a substrate. A "mid-phosphorous electroless nickel coating" refers to the nickel-phosphorous alloy being deposited by an electroless/autocatalytic process in which the resulting alloy consists of medium levels of phosphorus. The definition of medium levels is different in sources of different branches of technology according to use. The range accepted as medium levels can be (percent by weight): 4-7 (decorative purpose), 6-9 (industrial sources), or 4-10 (Electronic applications). The solution is typically composed of: a nickel source; reducing agent; complexing agent to increase phosphite solubility and also to slow down the reaction speed in order to prevent the white-out phenomena but are not co-deposited into the resulting alloy [carboxylic acids or amines]; stabilizers to slow down the reduction by co-deposition with the nickel [lead or sulphur or organics]; buffers; brighteners; surfactants; and accelerators to overcome the slow plating rate imparted by complexing agents. Medium phosphorus treatment has a high speed deposit rate and offers bright and semi-bright options for cosmetic particularization. High phosphorous coatings offer high corrosion resistance and contain higher amounts of phosphorous as compared to the mid-phosphorous coatings.

An "electrolytic coating" as used herein refers to a coating on a substrate that is formed by electroplating a thin layer of metal onto a metal object or substrate. The process uses an electrical current to reduce dissolved metal cations to form a cohesive coating. An "electrolytic nickel coating" uses nickel while "an electrolytic zinc coating" uses zinc.

Example 1

Preliminary Studies

Potassium permanganate has been discovered, when added to an anodizing solution, to minimize dimensional change. It is important that the permanganate is added to the anodizing solution itself and is not used as a pre- or post-treatment step to the anodizing process. Initial tests were conducted using 10% by weight sulfuric acid solutions to anodize 2024, 6061, and 7075 grade aluminum panels. Control specimen showed a dimensional growth of 50% of the aluminum oxide formation. When potassium permanganate was added to the solution at a concentration of 0.5% by volume of 1.0M potassium permanganate the dimensional growth was undetectable until the aluminum oxide formation reached 0.0005 inches. Once the aluminum oxide formation reached thicknesses above 0.0005 inches and the dimensional change was detectable, the overall dimensional change that was recorded was less than 10% of the total oxide formation.

As shown in FIG. 1, initial control trials were conducted using a 10% by weight sulfuric acid solution at between about 65°-75° F. Control specimens were anodized using 2024, 6061, and 7075 grade aluminum and were anodized to 0.0005 inches. The specimens were anodized for 30 minutes at a current of 12V DC at 22 amps/ft$^2$. The aluminum oxide thickness was tested via a dual-scope and dimensional change was measured via a micrometer. The dimensional change was 0.00025 inches.

As shown in FIG. 2, when 0.2% by volume of 1.0M potassium permanganate was added and panels were ran under the same conditions the dimensional change was reduced to 0.00005 inches.

An assay of the oxide thickness to growth ratio was conducted and the results are shown in FIGS. 3-5 for each of the types of aluminum studied. In the figures: Panel 1 corresponds to the specimen being anodized to 0.0001 inch; Panel 2 corresponds to the specimen being anodized to 0.0002 inches; Panel 3 corresponds to the specimen being anodized to 0.0003 inches; Panel 4 corresponds to the specimen being anodized to 0.0004 inches; Panel 5 corresponds to the specimen being anodized to 0.0005 inches; and Panel 6 corresponds to the specimen being anodized to 0.0007 inches.

As shown in FIGS. 3-5, anodizing the specimen to between 0.0001 inches to 0.0003 inches yielded no dimensional change in any of the specimens across the different types of aluminum.

No dimensional change was shown in 2024 or 7075 grade aluminum when the specimens were anodized to 0.0004 inches. (FIGS. 3 and 5) However, an average dimensional change of 0.00005 inches was shown for 6061 grade aluminum. (FIG. 4) The dimensional change in 6061 grade aluminum may be due to the lower impurity content of the aluminum.

As shown in FIGS. 3-5, anodizing the specimens to 0.0005 inches or 0.0007 inches yielded an average dimensional change of 0.00005 inches across all grades of aluminum. This dimensional change is significantly less than the dimensional change as a result of conventional sulfuric acid anodization.

When the concentration of sulfuric acid was increased to 20% by weight and ran under the same conditions the results did not yield the same pattern. Instead the measurable dimensional change occurred at 0.0003 inches across all three grades of aluminum. The average growth was 0.00005 inches. (results not shown)

When the potassium permanganate concentration was increased to 1% by volume of 1.0M potassium permanganate the results concluded that increasing the concentration had no additional effect of the anodize capabilities. (results not shown) When the concentration of potassium permanganate was increased to 10% by volume the anodizing process started to resume the normal oxide to dimensional change ratio as seen in the control. (results not shown)

In addition to the normal dimensional change, a brown deposit of manganese dioxide was observed on the surface of the aluminum when the concentration of potassium permanganate was increased. The brown deposit likely indicates that the solution has been overly saturated and the process would need to be stopped so that the solution can be treated. When the permanganate was depleted out of the solution a color change in the solution was observed from a deep purple to a light pink and ultimately to a transparent color. The color change of the solution is due to the reduction of the permanganate to Manganese II. When additions of more permanganate are added the potential reaction that occurs is the migration of Manganese II towards the cathode which then deposits onto the cathode or precipitates out of solution.

Materials and Methods

Anodizing Process

For the anodizing process, about 400 mL of deionized water was added to a 500 mL glass beaker followed by 50 mL (10% v/v) concentrated reagent grade sulfuric acid. The solution was allowed to cool to room temperature after which 1 mL of 1.00M (0.2% v/v) potassium permanganate was added to the solution. The solution was thoroughly mixed and deionized water was added to fill the solution to the 500 mL mark.

The resulting solution was placed in a 500 mL test plating cell. 5053 grade aluminum was used as the cathode with copper wire connectors. The test cell was placed in an ice bath until the temperature lowered to about 60° F.

A 2"×3" aluminum panel was cleaned with commercial methyl ethyl ketone. The cleaned aluminum panel was measured for thickness using a micrometer in several predetermined locations on the panel.

Once the solution reached about 60° F., the cleaned aluminum panel was placed into the solution and a portable rectifier, with settings of between about 13 VDC and about 15 VDC with an average of 1.3 amps, was powered on. The panel remained in the solution with constant voltage for between about 20 to about 30 minutes. After this time, the rectifier was turned off and the panel was removed from the solution, rinsed with deionized water and allowed to air dry.

After drying, the panel was measured in the same predetermined locations as initially measured to determine any changes in thickness. The process was repeated with the panel being immersed in the solution for varying times. (FIG. 6)

Control specimens of 2024, 6061 and 7075 aluminum were anodized using the conventional anodization process with 10% w/v of sulfuric acid. No oxidizing agent was added to the solution. The specimens were anodized to about 0.0005 inches by immersing the specimens in the anodizing solution for about 30 minutes at a voltage of about 12 VDC at about 22 amps/ft$^2$. The temperature of the solution during anodization was between about 60° F. to about 75° F. The aluminum oxide thickness was tested via a dual-scope and dimensional change was measured via a micrometer.

Methods of Results Analysis

The primary method of analysis was to measure the dimensional change of the panel via micrometer prior to being anodized and immediately after being anodized. The oxide thickness is measured using dual scope. Secondary tests were conducted such as salt spray testing and taber abrasion testing (results shown below in the Examples section). Tertiary testing was conducted including, but not limited to, scanning electron microscopy (SEM) and dye capabilities. SEM results are shown below in the Examples. Secondary and tertiary testing was conducted according to procedures known by those of ordinary skill in the art for each type of testing.

Variable Ranges

While a temperature of 60° F. was used in the experiments, a temperature range of between about 30° F. to about 120° F. may be used, including all temperatures in between. Temperature used is dependent on the type of acid or acid combination used in the anodizing solution.

Direct current (DC) was used in the above experiments; however alternating current (AC) pulse current or any other method of applied voltage may also be used. When using either AC or DC, the current voltage range can be between about 1V to about 100V or between about 10 amps/$ft^2$ to about 50 amps/$ft^2$.

Acid Types

In assessing the solution composition, three primary factors were used as assessment tools: Acid Conductivity, Applied Voltage, and Oxidation-Reduction Potential.

Acid Conductivity

Acid conductivity was assessed by using standard values of acid conductivities at varying concentrations to correlate to electrolyte capabilities.

Applied Voltage

When assessing the applied voltage, the comparison factor is the amount of amperes produced. Using a 500 mL test cell at a constant voltage of 15V DC at 65° F. for five minutes the following results were obtained on a 1"×1" test specimen:

TABLE 1

| Electrolyte | Permanganate | Amps | Thickness |
|---|---|---|---|
| $H_2SO_4$ 10% V/V | 0.6 g/L | 0.8 | 0.0005 |
| $H_2SO_4$ 10% V/V + 0.04M $H_3PO_4$ | 0.6 g/L | 0.3 | 0.0002 |
| $H_2SO_4$ 10% V/V + 0.4M $H_3PO_4$ | 0.6 g/L | 0.2 | 0.0001 |
| 4.0M $H_3PO_4$ | 0.6 g/L | 0.01 | 0.00008 |

As shown in Table 1, the current decreases as a less conductive acid is present. The less conductive acids produce the same anodic coating only slightly slower due to the lower current flowing through the working electrode. The coatings of the analysis were the same in appearance just at thinner coating thicknesses.

Oxidation-Reduction Potential

In assessing oxidation-reduction potential (ORP), the inventors found that permanganate has a significantly larger oxidation-reduction potential (ORP) as compared to water. The Table of Standard Reduction Potentials was used to compare and evaluate the total oxidative potential of the aluminum substrate the conventional method and the novel solution. The main oxidation force in conventional anodizing is the actual water in the solution which does not have a significant ORP, rather it uses the applied voltage and electron flow of the cell to force the oxidation of the aluminum substrate.

$H_2O$ has an ORP of +1.229 and has only one reaction to undergo in order to oxidize a substance as discussed above. Conversely, permanganate has a multitude of reactions that it can undergo to oxidize a substance. This combination of reactions allows for a continuous oxidative flow to the aluminum substrate. Accordingly, permanganate increases the ORP of the solution close to a factor of 10.

Using the above factors coupled with verification experiments, the inventors found that the following acids may be used as an electrolyte medium for permanganate oxidation of aluminum: nitric acid, sulfuric acid, phosphoric acid and boric acid. While sulfuric acid was used in the anodizing solution, other chemicals are contemplated by the invention including, but not limited to, those acids listed above as well as phosphoric acid, hydrochloric acid, citric acid, carboxylic acid and carbonic acid. The studies also found that oxalic acid, acetic acid, and glycolic acid are not compatible due to the oxidation of the carbon based anion by permanganate.

Based on conductivity of each acid, it was found that they all possess sufficient conductivity to permit enough current for a sufficient oxide layer. Sulfuric acid has the highest conductivity and has been shown to produce the best results. With addition of permanganate, the conductivity of the solution lowers slightly but not significantly.

Sulfuric acid may range in concentration between about 1% w/v to about 40% w/v, including all values in between. In some embodiments, the amount of sulfuric acid may range from about 8% w/v to about 25% w/v, including all values in between. In some embodiments, the amount of sulfuric acid may range from about 10% w/v to about 20% w/v, including all values in between. The concentrations of the various acids used vary from about 1% w/v to about 40% w/v depending on the specific acid and its specific interaction with the other chemicals.

Combinations of acids are also contemplated by this invention with the concentrations of the acids used being variable according to the specific acids used and their interaction together. Any combination of acids listed will be a suitable electrolyte. The only difference that will be observed is the applied voltage in order to produce a sufficient anodic coating.

Combinations of acids may include, for example, a 10% w/v concentration of sulfuric acid combined with a 1% w/v concentration of nitric acid, phosphoric acid, hydrochloric acid, citric acid, boric acid, carboxylic acid, or carbonic acid.

The inventors further found that optionally adding 0.04% w/v phosphoric acid to the solution was able to preserve the permanganate in the anodizing solution while only having a slight effect on the speed of the anodizing process. Preserving the permanganate in solution allows the permanganate to be sustained in its fully oxidized state. In doing so, when current is applied, all of the oxidative potential is focused to the working electrode which allows for more efficient coatings, but will sacrifice some speed due to the lower conductivity of the solution.

Use of Permanganate

Potassium permanganate was used in the experiments described herein, however other oxidizing agents are contemplated by the invention including, but not limited to, sodium orthovanadate, sodium persulfate, ammonium persulfate, potassium persulfate, sodium permanganate, hydrogen permanganate and lithium permanganate. Many other oxidizers are contemplated by this invention; however it is preferable that the oxidizer is environmentally safe at the concentration used.

Potassium permanganate is the most readily usable chemical for this process. It has a high oxidizing potential, and is highly stable, as in no manganese dioxide or other byproducts are formed, in acidic solutions. Another classification of chemicals that can be used is the persulfate group. The persulfates have relatively the same high oxidizing potential of the permanganates except that they are not as stable in acidic solution. They readily disassociate from persulfate ($S_2O_7$)) to sulfate ($SO_4$). If a stabilization method was produced, this group of chemicals may also be used in the novel composition described herein.

Potassium permanganate, depending upon acid strength, may range in concentration between about 0.01% w/v to about 10% w/v, including all values in between. The amounts of other oxidizers used may vary according to the specific oxidizer.

After analyzing the chemical properties of permanganate, the inventors concluded that the active component is the permanganate anion. Oxidation of the aluminum requires an oxygen source. When using the half-cell reaction for permanganate, the cation is an irrelevant aspect of the reaction. Thus, the cation is an irrelevant aspect of the solution composition. The cations that may be used with the permanganate anion include, but are not limited to, sodium, potassium, hydrogen, and lithium.

Each cation offers a different disassociation and solubility constant for the release of the permanganate ion into solution. At the concentration specified in the parameters described herein both the disassociation and solubility constant have no effect on the solution.

Each salt of permanganate has a different level of complexity when it comes to manufacturing. Potassium permanganate is the easiest to manufacture and therefore is the least expensive. Sodium permanganate is the next least expensive but there is a noticeable increase in price. Lithium permanganate and permanganic acid (hydrogen permanganate) are difficult to make and therefore are extremely expensive.

When hydrogen permanganate is in solid form it is a salt and when hydrogen permanganate is dissolved into just water it makes the permanganate ion. When any permanganate is dissolved into an acidic solution with high levels of excess (H+) ions permanganic acid is formed in equilibrium with the permanganate ion.

Due to potassium permanganate's high disassociation constant, the permanganate salts form permanganic acid when in acidic solution. Due to this property a 6061 Aluminum test specimen was anodized in a 500 mL solution of 10% w/v of potassium permanganate and 0.0072% w/v of sulfuric acid according to the procedures described herein. The results concluded that oxidation of the aluminum does occur but the solution in not conductive enough to be able to produce a sufficient oxide layer. This is due to the insulating properties of the aluminum oxide coating the solution requires a significant level of conductivity to overcome the electrical shielding of the aluminum oxide coating.

It is found that hydrogen permanganate, permanganic acid, alone is not a sufficient electrolyte and is unable to undertake two applications at once, electrolyte and oxidizer. (results not shown) For conventional anodizing, there is just an electrolyte in deionized water. For the novel process described herein, there are 2 constituents, or 2 reaction pathways, needed. One is an electrolyte and the other is an oxidant. The use of permanganates as an oxidant is what works. Permanganates as an oxidizer and electrolyte fails because permanganate has a really low conductivity. So there is a need for an acid electrolyte in order for the permanganate to be focused on the oxidation pathway.

Determining the Optimal Acid Concentration

In order to determine the optimal acid concentration, studies are conducted on the various acids enumerated above, starting with sulfuric acid. Once each acid is analyzed individually, combinations of the acids are tested to determine optimal concentrations. Procedures used to determine optimal acid concentration are similar to those enumerated in the Materials and Methods section above.

Solutions of acid are tested at about 0.01% w/v, about 1% w/v, about 8% w/v, about 10% w/v, about 13% w/v, and about 20% w/v. Each solution is subjected to three test runs with four 3"×10" aluminum panels with a different grade of aluminum being used for each of the three test runs (2024, 6061 or 7075). Potassium permanganate is used in the solution in the amount previously shown to be effective in controlling oxide formation (0.2% v/v). Each test run lasts about 20 minutes.

Each metal specimen for each test run is measured in several predetermined locations to determine starting thickness of the metal specimen. For example, the metal specimen is measured at each of the 4 corners and the center as well as between about 3-4 random locations. After each test run, each metal specimen is measured at the same predetermined locations to determine the ending thickness. Dimensional change and oxide thickness are determined by calculating the difference between the starting and the ending thickness of the metal specimen at the same predetermined locations.

All panels are subject to visual examination for non-conformance, such as discoloration, non-uniformity, smut on the surface, etc. At least one panel is subjected to testing for salt spray, dye capabilities, coating weight or taber abrasion. The panel is also tested by cross-section analysis to determine pore structure. For example, scanning electron microscopy (SEM) may be used to produce an image of the shape of the pore that is formed and the user would visually analyze the shape of the pore from the image.

Optimal Oxidizing Agent Concentration

Procedures are followed as detailed in the materials and methods section with the operating conditions being substantially similar to those described previously. An additional control test is conducted prior to the optimal concentration analysis in which four 3"×10" 6061 aluminum panels are immersed for about 30 minutes in a solution of 10% w/v sulfuric acid and 1.25% w/v potassium permanganate. A sample of the solution is taken every 5 minutes and analyzed for permanganate concentration to determine the depletion rate of the permanganate. The depletion rate of the permanganate allows an auto-feeding system to keep the permanganate concentration constant. With an auto-feeding system feeding 10% v/v potassium permanganate at a constant volume and at a constant time interval, the potassium permanganate concentration may be kept constant. Depletion rates may be calculated for other oxidizing agents as well using the same general procedures.

The optimal acid concentration (as discovered above) is used in the solution with the oxidizing agent concentration being varied. For potassium permanganate, solution concentrations of 0.01% v/v, 0.2% v/v, 0.5% v/v, 1.0% v/v, 5% v/v and 10% v/v of 1.0M standardized solution of potassium permanganate were studied to determine the optimal concentration. Results are shown in the Examples. Similar concentrations and procedures are used for the other oxidizing agents listed above.

Optimal Temperature

Optimal acid and oxidizing agent concentrations are used in the operating procedures enumerated previously with the temperature of the solution varied to determine the optimal temperature for the reaction to occur. Temperature conditions are tested at about 30° F., about 40° F., about 50° F., about 60° F., about 70° F., about 80° F., about 90° F., about 100° F. and about 110° F. Primary focus is given to temperatures between about 30° F. and about 80° F. The other listed temperatures are tested with extreme conditions of previous experiments such as high temperature, low acid concentration and high oxidizing agent concentration. In the previous example, high temperatures would be any temperature above 80° F., low acid concentration would be a concentration of 5% or below depending on the acid, and high oxidizing agent concentration would be a concentration of 5% or higher depending on the oxidizing agent.

Optimal Voltage

Using the optimal parameters already determined for acid concentration, oxidizing agent concentration and temperature, voltage is varied to determine the optimal voltage for the reaction to occur according to the general operating procedures enumerated previously. Voltage conditions are varied between 1V to about 100V or between about 10 amps/ft$^2$ to about 50 amps/ft$^2$. Primary focus is on the current operating parameters of conventional anodizing and the ranges nearest these parameters. An exemplary range is between 20 amps/ft$^2$ to about 30 amps/ft$^2$. However, depending on the total surface area of the anode (test specimen) and the cathodes, the voltage to achieve the amps/ft' can vary. Extreme voltages are tested with other extreme conditions such as low voltage at a high temperature, low acid concentration and high oxidizing agent concentration.

Optimum Conditions for Other Light Metals

The experiments used to determine the optimum conditions used for aluminum alloys are then used to determine optimum conditions for other light metals including, but not limited to, titanium, magnesium, zinc, niobium, zirconium, hafnium and tantalum.

Example 2

Solution Photometric Properties

Potassium permanganate was analyzed photometrically using a Jenway 6505 UV/Vis Spectrophotometer with optical plastic cuvettes. It was determined that the most applicable wavelength for the measurement of potassium permanganate is 523 nm at a concentration range of 0.005-0.05 g/L (0.0005-0.005% w/v) with a path length of 1.0 cm. For higher concentrations a shorter path length would be required along with an optical glass or quartz cuvette. The photometric properties of this solution apply to the methods of analysis of solution concentration and the implementation of automatic instrumental dosing systems.

Materials and Methods

Solutions

10% Sulfuric Acid

A stock solution of 10% v/v solution of sulfuric acid was made by volumetrically pipetting out 10.2 mL of 98% sulfuric acid (ACS Reagent Grade) and adding it into a 1 L volumetric flask. The flask was then filled to the mark with deionized water produced by carbon filtration—reverse osmosis—media filtration process.

50 g/L (5.0% w/v) Potassium Permanganate

A stock solution of 5% w/v solution of potassium permanganate was made by dissolving 5.00 g of potassium permanganate into 100 mL of deionized water measured out volumetrically.

0.1 g/L (0.01% w/v) Potassium Permanganate in 10% Sulfuric Acid 1.0 mL of the potassium permanganate solution was volumetrically transferred into a 100 mL volumetric flask and filled to the mark with the 10% sulfuric acid solution.

Method

Wavelength Determination

Using an optical plastic cuvette, 0.1 mL of the 0.1 g/L potassium permanganate/10% sulfuric acid solution was transferred into the cuvette. 1.9 mL of D.I. water was transferred into the cuvette and mixed thoroughly. The cuvette was then placed in the cuvette holder. A wavelength scan from 190 nm-1100 nm was conducted with increments of 10 nm.

A wavelength scan from 440 nm-640 nm was conducted with increments of 5 nm. Peak isolation was found at 500 nm-540 nm.

A wavelength scan from 500 nm-540 nm was conducted with increments of 1 nm. Peak determination was found at 520 nm-525 nm.

A wavelength scan from 520 nm-525 nm was conducted with increments of 0.2 nm. Final wavelength determination at 523 nm.

Linearity of Concentration Gradient

A quantitation analysis of potassium permanganate was conducted for the determination of potassium permanganates linearity across a concentration gradient. Seven optical plastic cuvettes were obtained and filled with the following contents:

Cell 1—Nothing

Cell 2—2 mL D.I. Water

Cell 3—0.1 mL of 0.1 g/L Permanganate/10% Sulfuric Acid solution, 1.9 mL D.I. Water Cell 4—0.2 mL of 0.1 g/L Permanganate/10% Sulfuric Acid solution, 1.8 mL D.I. Water Cell 5—0.5 mL of 0.1 g/L Permanganate/10% Sulfuric Acid solution, 1.5 mL D.I. Water Cell 6—1.0 mL of 0.1 g/L Permanganate/10% Sulfuric Acid solution, 1.0 mL D.I. Water Cell 7—2.0 mL of 0.1 g/L Permanganate/10% Sulfuric Acid solution.

Cell 1 was used to standardize the light and dark levels. Cell 2 was used as a zero. Cells 3-7 were used as the concentration gradient. The quantitation function standardizes with cell 1 and then cycles through cells 2-7. Multiple cycles will standardize only once and then cycle through the specified cells as many times it is set to do.

With all cells in use with 3 cycles and a path length of 1.0 cm, the slope equation, r value, and $r^2$ value are as follows:

| | | |
|---|---|---|
| Conc. = 0.430 Abs − 0.036 | r = 0.978 | $r^2$ = 0.956 |

With cells 1-5 in use and with 3 cycles and a path length of 1.0 cm, the slope equation, r value, and $r^2$ value are as follows:

| | | |
|---|---|---|
| Conc. = 0.289 Abs − 0.010 | r = 1.000 | $r^2$ = 1.000 |

The inventors found that the most applicable wavelength for the measurement of potassium permanganate is 523 nm at a concentration range of 0.005-0.05 g/L (0.0005-0.005% w/v) with a path length of 1.0 cm.

For higher concentrations a shorter path length would be required along with an optical glass or quartz cuvette.

Example 3

Small Scale Dimensional Analysis

This analysis was conducted to verify the concept of the limited growth anodizing process by the addition of potassium permanganate into a conventional anodizing solution.

Materials and Methods

All panels were anodized without any prior cleaning. A solution of 10% w/v sulfuric acid was made by adding 102 mL of 98% sulfuric acid (ACS Reagent Grade) into a 1 L volumetric flask and diluting to the mark. The solution was then chilled in a refrigerator to about 50° F. An ice bath was made in the plastic container to regulate the temperature of the anodize solution. Once cooled to about 50° F., 500 mL of the 10% w/v sulfuric acid solution was poured into a 500 mL polyethylene tank. Potassium permanganate was added to the process solution to a concentration of 0.06 g/L (0.006% w/v).

Two Aluminum Panels were wired together with copper wire and connected to the cathode of the DC Rectifier. Half of these panels were immersed in the solution. An aluminum panel was connected to the anode of the DC Rectifier and ½ of the panel was immersed into the solution between the two cathode panels.

The tank was then fixed with a thermometer to regulate the temperature between about 60-70° F. This was done by either insertion into the ice bath or removal from the ice bath respectively. The DC rectifier was then turned on and adjusted to 15 Volts DC with a current of 1.2 Amp. The panels were allowed to anodize for 15 minutes. At the end of the anodize period the aluminum panel connected to the anode was removed, washed with deionized water and force air dried.

An iso-scope was used to determine the thickness of the anodic coating. Thickness measurements were taken on the anodized area (portion immersed into solution) and the un-anodized area (portion out of solution).

The results of this analysis are shown in FIG. 7. Panel 1 is the control specimen and shows the 50% growth. Panels 2, 3, and 4 were anodized in a solution that was dosed with permanganate. Panel 2 was used as a direct comparison to the control specimen in that it is the same material and same anodize duration. Panels 3 and 4 were used to assess the other aluminum alloys. The dimensional growth was not observed as a significant factor in this assessment. Component is a stock solution of 1.0N potassium permanganate. The anodic coating that was produced was 0.0005" thick. The thickness measurements of both sections of the panel were identical within the capabilities of our measuring instruments. The thickness measurements were 0.0303". This method proved that it is feasible to produce an anodic coating on anodized aluminum without changing the overall dimensions.

Example 4

Midscale Assessment of Dimensional Change and Solution Reaction Properties

The objective of this analysis was to ensure the same results as the small scale assessment and to observe and analyze the solution properties and capabilities, and anodic coating properties of the panels that are produced.

Materials and Methods

A 10 gallon polypropylene tank was fixed with an inlet and outlet orifice. A one inch flexhose was fixed to the outlet of the tank and to the inlet of a fluid pump. The fluid pump's outlet was fixed to the inlet of a solution chiller. The solution chiller's outlet was fixed to the inlet of the 10 gallon tank. A copper bar was fixed to the center of the tank and connected to the anode of the DC Rectifier with a copper wire. A 6061-T6 Aluminum Panel was wired to the cathode of the DC Rectifier and was immersed into solution to enough to keep a 4:1 anode-cathode surface area ratio.

A solution of 184 g/L (10% w/v) sulfuric acid was made by mixing 1.07 gallons of 93% sulfuric acid with 8.93 gallons of deionized water. The sulfuric acid solution was allowed to cool to room temperature and then poured into the tank. Two grams, 0.05% w/v, of potassium permanganate was added to the solution prior to each anodize trial listed below. After each run the solution was allowed to become transparent prior to another addition of potassium permanganate and another trial being ran.

Thickness of each panel was taken in five random points on each panel prior to each trial. These thickness locations were measured and sketched for reference after the trial. The solution was kept at 65° F. and 15 volts DC was used for the following trials:

Sample 1—One 3"×10" 6061-T6 Aluminum panels were anodized for 15 minutes with a current of 8 Amps.

Sample 2—One 3"×3" 6061-T6 Aluminum panels were anodized for 30 minutes with a current of 8 Amps.

Sample 3—One 3"×10" 2024 Aluminum panels were anodized for 15 minutes with a current of 8 Amps.

Sample 4—One 3"×10" 2024 Aluminum panels were anodized for 30 minutes with a current of 8 Amps.

Sample 5—One 3"×10" 7075 Aluminum panels were anodized for 15 minutes with a current of 8 Amps.

Sample 6—One 3"×10" 7075 Aluminum panels were anodized for 30 minutes with a current of 8 Amps.

Results

The results for the 6061-T6 Aluminum are shown in FIG. 8. The results were as predicted in that the anodic coating did not form as fast as in the small scale trial due insufficient current being applied. The thickness changes for the 6061 and 7075 Aluminum panels were as successful as that shown in the small scale trial in that no dimensional changes were able to be recorded with anodic thicknesses of 0.0004"-0.0006". The 2024 Aluminum panels showed a thickness change of 0.00005" with anodic thicknesses of 0.0005". Even with the measurable growth, it is 80% less growth than that of conventional anodizing and 10% total dimensional growth.

The solution's capability to reduce the permanganate component when there is no trial being run suggests that there are supplementary reactions occurring in the solution. Further analysis will need to be done to verify the solution composition through the progression of the solutions use.

An analysis of the anodic coating weight and anodic coating density was conducted to analyze the effects of minimal growth on anodic coating formation. The anodic coating weight averaged at 5000 mg/ft$^2$. The density of the anodic coating is 1.96 oz/in$^3$. Unexpectedly, the inventors found that the weight is roughly three to four times the weight of conventional anodizing and is only about 10% less than that of pure aluminum oxide. Having a higher coating weight at the same anodic coating thicknesses shows that the diameter of the pore is drastically reduced. The ratio of pore volume to anodic coating cell volume is significantly less. This is desired since the protection capabilities of coatings with smaller pores is higher, thus allowing for greater protection at thinner coating thicknesses.

Example 5

Full Scale (Large) Production Verification

The objective of this analysis was to test the feasibility of a large scale production application and how the solution, process, and properties are affected by load sizes and voltage and current fluctuations. This test also serves to assess the ability for the conversion from a conventional anodizing solution with an electrolyte additive to the method using the novel composition described herein.

Materials and Methods

A 340 gallon polypropylene tank was pre-plumbed to a chilling system to regulate solution temperature. The tank was pre-fitted with a copper bar connected to the anode of the DC Rectifier, and also pre-fitted with four 3'×4' 5053 Aluminum plates connected to the cathode of the DC Rectifier.

The pre-existing solution contained 230 g/L of sulfuric acid (12.5% w/v) with 4% v/v of an electrolyte additive. Potassium permanganate was added to the solution in 500 g doses while it was chilled and allowed to mix for 30 minute increments. This was repeated until no color change from deep purple to clear was observed.

Once no color change was observed, 0.5 g/L, 0.05% w/v, of potassium permanganate was added to the solution. The dimensional thickness and weight of two (2) 6061-T6 Aluminum test panels was measured and recorded as described previously. The test panels were placed into solution and anodized for 10 minutes at 15 volts DC and 125 amps. The test panels were then rinsed with D.I. Water and force air dried. Their anodic coating thickness, dimensional thickness, and weight were measured and recorded (FIG. 9).

Conventional anodizing is time consuming. Using the novel solution described herein, the inventors are able to anodize metals such as aluminum considerably faster than conventional anodization as shown in FIG. 10.

Figure 11:
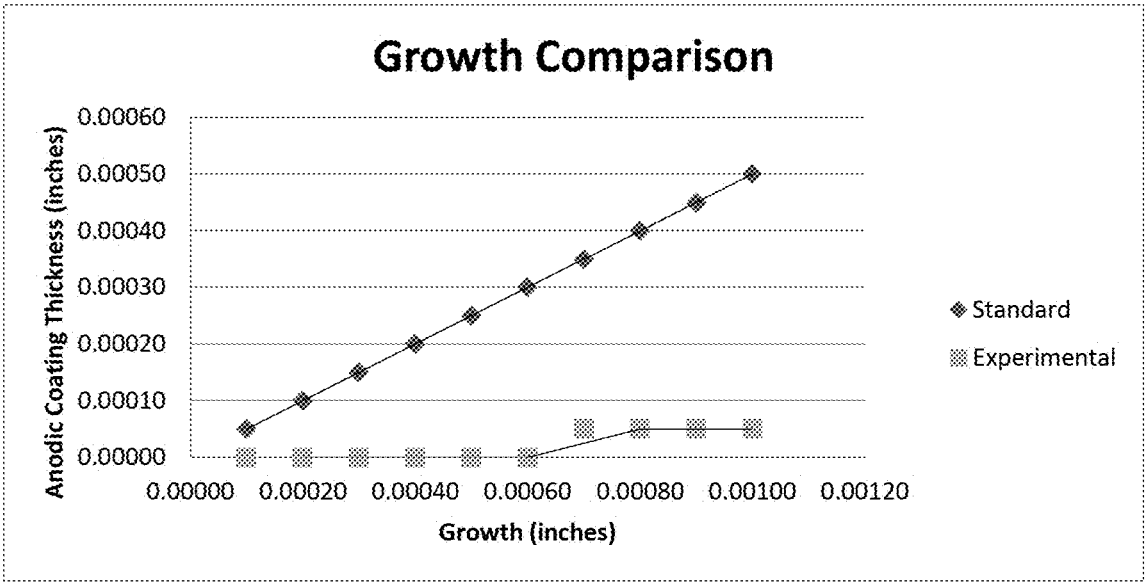
FIG. 11 is a graph comparing the conventional method of anodizing versus the method described herein with regard to anodic thickness as a function of dimensional growth.

Further, the inventors found that dimensional growth increases substantially as anodic coating thickness increases when the standard method of anodizing is used as opposed to using the novel method and solution as described herein (FIG. 11). Using the novel method and solution as described herein allows for very little dimensional change while still allowing for the anodic coating.

Example 6

Salt Spray Analysis

The composition and method described herein provide significant improvements over prior methods of using anodizing in a marine environment and having the anodized aluminum capable exhibiting corrosion resistance to the salt spray. The inventors unexpectedly found that anodized aluminum using the method and composition described herein was able to withstand a salt spray duration of about 800 hours before showing any signs of fatigue. This exceeds the current requirements of 336 hour minimum as specified in anodizing specifications.

Materials and Methods

Five (5) 3"×10" 6061 Aluminum test specimen were anodized in a Large Scale Tank (340 gallon tank) for the purpose of analyzing their corrosion resistance capabilities in a salt spray chamber per ASTM B117. The panels were anodized to a thickness of 0.0003 inches.

The anodizing solution used contained 230 g/L sulfuric acid (13.86% v/v Technical Grade Sulfuric Acid) and 0.1-0.2 g/L Potassium Permanganate (0.01-0.02% w/v Technical Grade Potassium Permanganate). The temperature of the solution was held constant at 65° F. The voltage applied was held constant at 15V DC. One test specimen was placed in a dichromate seal for approximately 15 minutes. The other 4 test specimens were left unsealed.

The test specimens were tested in accordance with MIL-A-8625 which states that the specimens must incubate in a salt spray chamber for a minimum of 336 hours and have no more than 5 isolated pits that are no more than 0.031 inches in diameter per test specimen.

Results

All five (5) test specimen were able to withstand 800 hours before showing any signs of fatigue. Anodized aluminum requires a salt spray duration of 336 hours. In general, test specimens using the conventional anodizing method will have at least 2-3 pits at 336 hours in the salt spray chamber. Marine environment aluminum oxide coatings require a salt spray duration of 500 hrs. The inventors' aluminum oxide coating showed no signs of fatigue at those time periods and withstood a duration of 800 hrs before showing any signs of fatigue at only 0.0003 inches of anodic coating. The inventors' test specimens had no pits at the 336 hour mark and continued to have no pits until 800 hours in the salt spray chamber. Results are shown in the table of FIG. 12.

In summary, the corrosion resistance capabilities of the coating formed in the presence of potassium permanganate showed better ability to withstand corrosion than anodic coatings formed by conventional methods. Typically at 336 hrs conventionally anodized aluminum will show signs of pit formation but will not fail the test. The new process showed no sign of pit formation until 800 hrs was reached.

Example 7

Taber Abrasion Analysis

The taber abrasion test is used to measure abrasive wear. Typically, anodic coatings require 0.002 inches of anodic coating produced by the hard coat method in order to pass taber abrasion testing. The inventors unexpectedly found that using their composition and method, they were able to form a coating having less than half the anodic thickness and have it withstand at least two back to back taber abrasion tests. It is possible that the coating would pass three or more taber abrasion tests.

Materials and Methods

Two (2) 4"×4" 6061 Aluminum test specimen were anodized in a Large Scale Tank (340 gallon tank) for the purpose of analyzing their abrasion resistance capabilities. The panels were anodized to a thickness of 0.0008 inches and 0.0012 inches.

The anodizing solution used was 230 g/L sulfuric acid (13.86% v/v Technical Grade Sulfuric Acid) and 0.1-0.2 g/L potassium permanganate (0.01-0.02% w/v Technical Grade Potassium Permanganate). The temperature of the solution was held constant at 65° F. The voltage applied was held constant at 15V DC.

The test specimens were left unsealed. The test specimens were sent to Omega Research Corps. for taber abrasion testing in accordance with MIL-A-8625. Instructions were given that if both specimen were to pass, to take the specimen with an anodic coating of 0.0008 inches and to run the test again.

Results

Both specimens passed the taber abrasion test with a wear index of 0.9 for the specimen with 0.0008 inches of anodic coating and 1.0 for the specimen with 0.0012 inches of anodic coating. The specimen with 0.0008 inches of anodic coating passed a subsequent taber abrasion analysis with a wear index of 1.1. For reference, a wear index of 1.5 results in a failure for anodic coatings on 6061 Aluminum Alloys. As shown in FIG. 13, both specimens having a significantly reduced anodic coating thickness passed the taber abrasion test.

In summary, with only half the anodic coating of conventional hard coat anodizing, the novel composition and method of forming an anodic coating on aluminum showed the same results on the initial tests as conventionally anodized aluminum. The significant difference comes from the second taber abrasion test ran on a specimen. The wear index did not significantly change. It can be concluded that with only half of the recommended anodic coating, the novel coating is equally as durable to initial taber abrasion testing and is superior in longer taber abrasion testing than conventional hard coat anodic coatings.

Example 8

Coating Weight Analysis

In general, anodic coating specifications require a coating weight of 200-500 mg/ft$^2$ for an anodic coating that is 0.0001-0.0003 inches in thickness and a minimum of 1000 mg/ft$^2$ for anodic coatings that are 0.0004-0.0006 inches in thickness. For Hard Coat Anodizing, specifications state that for an anodic coating that is 0.0018-0.0022 inches in thickness the anodic coating weight should be a minimum of 4000 mg/ft$^2$.

The novel anodic coating described herein had an anodic coating weight of 2639.52 mg/ft$^2$, which is five times the weight required by specifications at a thickness of 0.0001-0.0006 inches. The novel coating also exhibited over half the coating weight of a Hard Coat with only ⅙ of the anodic coating thickness.

Materials and Methods

Five (5) 6"×4" 6061 Aluminum test specimens were anodized in a Large Scale Tank (340 gallon tank) for the purpose of analyzing anodic coating weight per MIL-A-8625. The panels were anodized to a thickness of 0.0003 inches.

The anodizing solution used in the experiments was about 230 g/L sulfuric acid (about 13.86% v/v Technical Grade Sulfuric Acid) and about 0.1-0.2 g/L potassium permanganate (about 0.01-0.02% w/v Technical Grade Potassium Permanganate). The temperature of the solution was held constant at about 65° F. The voltage applied was held constant at about 15V DC.

One test specimen was placed in a dichromate seal for approximately 15 minutes. The other 4 test specimens were left unsealed.

Figures 14, 15:
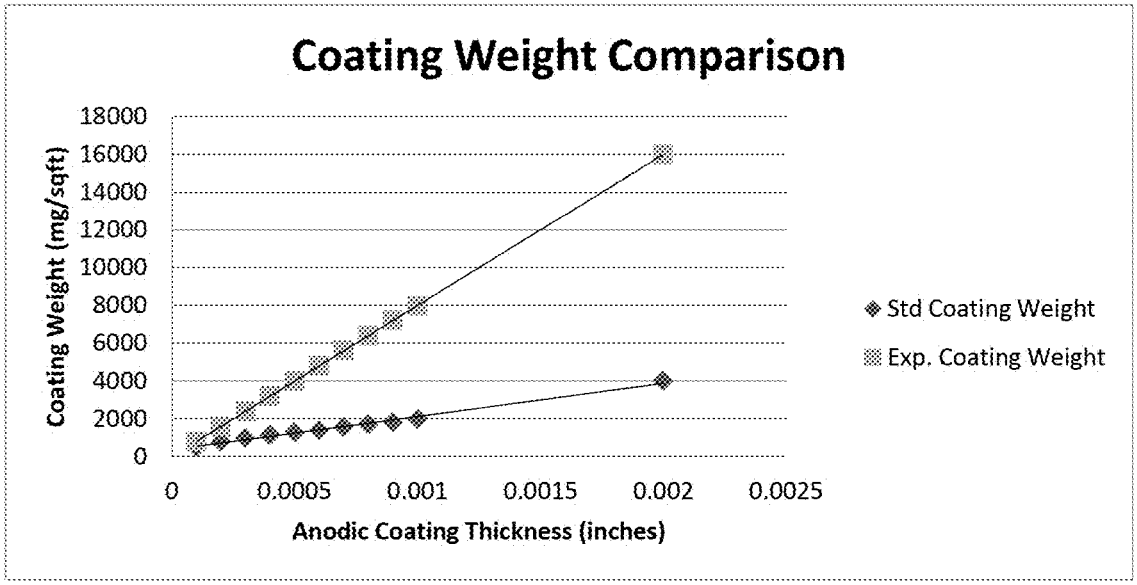
FIG. 14 is a table depicting the results of the coating weight analysis. As shown in the table, the anodic coating described herein exhibited over half the coating weight and about ⅙ the anodic coating thickness of a conventional Hard Coat anodic coating.
FIG. 15 is a graph depicting conventional method of anodizing versus the method described herein with regard to coating weight as a function of anodic thickness.

As shown in FIG. 14, the five (5) test specimens had an average coating weight of 2639.52 mg/ft$^2$. As stated above, unexpectedly this anodic coating weight is five times the weight required by the specifications for the required thicknesses. In comparing to Hard Coat anodizing, the novel composition and method described herein was able to exhibit over the same coating weight of a Hard Coat with only half of the anodic coating thickness. A comparison of conventional anodizing and anodizing with the novel solution described herein is shown in FIG. 15.

In summary, by anodizing aluminum in the presence of potassium permanganate, the inventors were able to obtain a significantly larger coating weight at the same thickness as conventional coatings. In addition, unexpectedly, the coating weight of the novel coating described herein was found to exhibit the same anodic coating weight with roughly half of the anodic coating thickness as traditional hard coat anodize. These unexpected results with respect to the novel composition and method described herein are likely due to minimal pore formation. Since the density of a substance only changes with temperature, the factor that gives rise to the greater coating weight is the minimal pore formation (i.e. smaller diameter, less porosity, both).

Example 9

Process Operation Capabilities

The composition and method described herein provide significant improvements over prior methods of applying voltage and current to the process solution. The inventors unexpectedly found that by applying a constant voltage to produce an anodic coating, that the coating weights exceed that of traditional hard coat anodic coatings. The current methods involve periodic increases in applied voltage while keeping the current to the solution at a constant value.

Materials and Methods

Five (5) 6"×4" 6061 Aluminum test specimens were anodized in a Large Scale Tank (340 gallon tank) for the purpose of analyzing anodic coating weight per MIL-A-8625. The panels were anodized to a thickness of 0.0003 inches.

The anodizing solution used was 230 g/L sulfuric acid (13.86% v/v Technical Grade Sulfuric Acid) and 0.1-0.2 g/L potassium permanganate (0.01-0.02% w/v Technical Grade Potassium Permanganate). The temperature of the solution was held constant at 65° F. The voltage applied was held constant at 15V DC.

The current was observed to be a value of 10 amps (45 amps/ft$^2$). This was held constant for 3-5 minutes.

Results

By applying constant voltage, thicknesses and coating weight were able to be achieved that exceed the requirements of the traditional methods of hard coat anodizing.

In summary, the applied voltage for traditional hard coat anodizing requires periodic increases in order to build thicker anodic coatings. This is due to the non-conductive properties of aluminum oxide. In order to produce thick coatings, the voltage differential across the anodic coating needs to be high enough to induce oxidation. As the coating becomes thicker, high voltages need to be applied, otherwise the coating will "burn" or become brittle and dissipate off the substrate. The novel process has been shown that the requirement for periodic increases in voltage is not required in order to obtain higher coating weights with thinner anodic coatings.

Example 10

Micrograph Analysis

Microthickness testing was used to verify that the thickness measurements taken were accurate. Micrograph testing was also conducted in which images of the samples were examined, however these results were inconclusive as it was found that a higher magnification was needed.

Materials and Methods

One (1) 3"×3" 6061 Aluminum test specimen was anodized in the Large Scale Tank (340 gallon tank) for the purpose of analyzing micro thickness and coating properties. The panel was anodized to a thickness of 0.00042.

The anodizing solution was 230 g/L sulfuric acid (13.86% v/v Technical Grade Sulfuric Acid) mixed with 0.1-0.2 g/L potassium permanganate (0.01-0.02% w/v Technical Grade Potassium Permanganate).

The temperature of the solution was held constant at 65° F. The voltage applied was held constant at 15V DC.

One (1) 3"×3" 6061 Aluminum test specimen was anodized to a thickness of 0.00061 inches in a standard anodizing solution of 183 g/L sulfuric acid at 65° F. with a constant voltage of 15V DC.

The test specimens were left unsealed and were sent to Omega Research Corps. for micrograph and micro thickness testing in accordance with MIL-A-8625.

As shown in FIG. 16, the method used to test anodic coating thickness was accurate based on visual measurements under magnification. It was also concluded that high magnification is required to see pore formation. The anodic coating interface for masking showed the same pattern and is inconclusive to the solution effectiveness except for the visual inspection of the test specimen appeared to a sharper masking interface. (results not shown)

Example 11

Paint Adhesion Testing

Anodized samples were tested for the coating's ability to allow paint to adhere. It was found that the novel anodic coating allowed for excellent paint adhesion.

Materials and Methods

One (1) 3"×10" 6061 Aluminum test specimen was anodized in the Large Scale Tank (340 gallon tank) for the purpose of analyzing paint adhesion via FED-STD-141D Method 6301.3. The panels were anodized to a thickness of 0.0003 inches.

The anodizing solution was 230 g/L sulfuric acid (13.86% v/v Technical Grade Sulfuric Acid) mixed with 0.1-0.2 g/L potassium permanganate (0.01-0.02% w/v Technical Grade Potassium Permanganate).

The temperature of the solution was held constant at 65° F. The Voltage applied was held constant at 15V DC. The test specimen was left unsealed.

As shown in FIG. 17, paint adhesion to the anodic coating was found to be excellent. There were no signs of intercoat separation and no clear significant differences when analyzing this test solely.

Example 12

SEM Analysis

Samples having the novel anodic coating were sent for topographical and cross section images. It was found that the novel anodic coating did not show signs of pore formation or microfractures as are found with the conventional method of anodizing.

Materials and Methods

Two (2) 3"×10" 6061 Aluminum test specimen were anodized in the Large Scale Tank (340 gallon tank) for the purpose of analyzing their porosity and morphology of the anodic coating. The panels were anodized to a thickness of 0.0003 inches and 0.0014 inches.

The anodizing solution was 230 g/L sulfuric acid (13.86% v/v Technical Grade Sulfuric Acid) and 0.1-0.2 g/L potassium permanganate (0.01-0.02% w/v Technical Grade Potassium Permanganate).

The temperature of the solution was held constant at 65° F. The voltage applied was held constant at 15V DC.

One (1) test specimen had an anodic coating thickness of 0.0004 inches, and the other had an anodic coating of 0.0014 inches. No growth was observed in the sample with 0.0004 inches of anodic coating but 3% growth was observed in the sample with 0.0014 inches of anodic coating.

The specimens were sent unsealed to Constellation Technology Corp. where they conducted an SEM-EDS topographical image and cross section. The surface of the anodized layer was examined in the as-received condition. A portion of the aluminum was sectioned, mounted in Bakelite, polished, and examined using a scanning electron microscope with an energy dispersive spectrometer (SEM-EDS).

As shown in FIGS. 18-24, the anodic coatings did not show any signs of pore formation or micro fractures. Macro pores formed due to surface contamination in the sample with 0.0004 inches of anodic coating. These macro pores were not present in the sample with 0.0014 inches of anodic coating.

Figure 19:
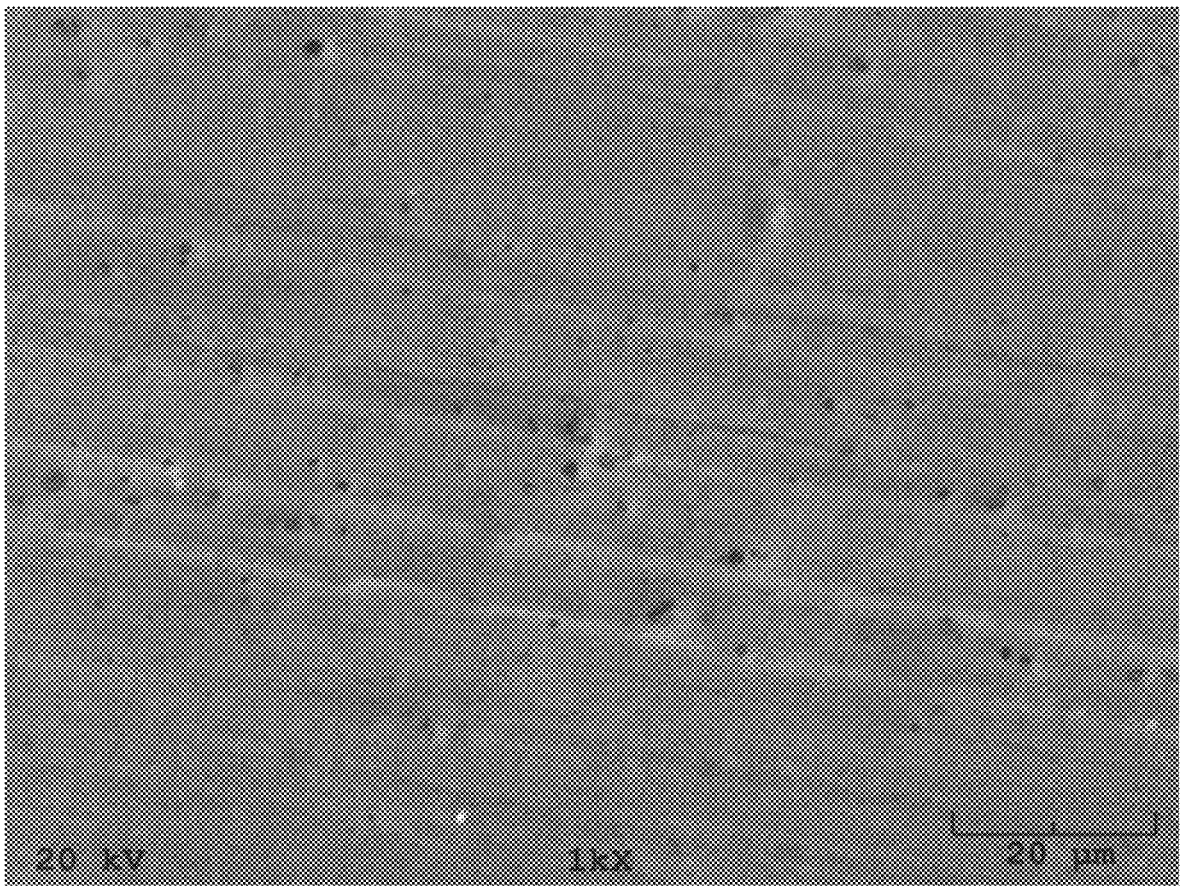
FIG. 19 is an SEM-EDS backscatter image of the surface of specimen 11520149 (Sample 1).
Figure 20:
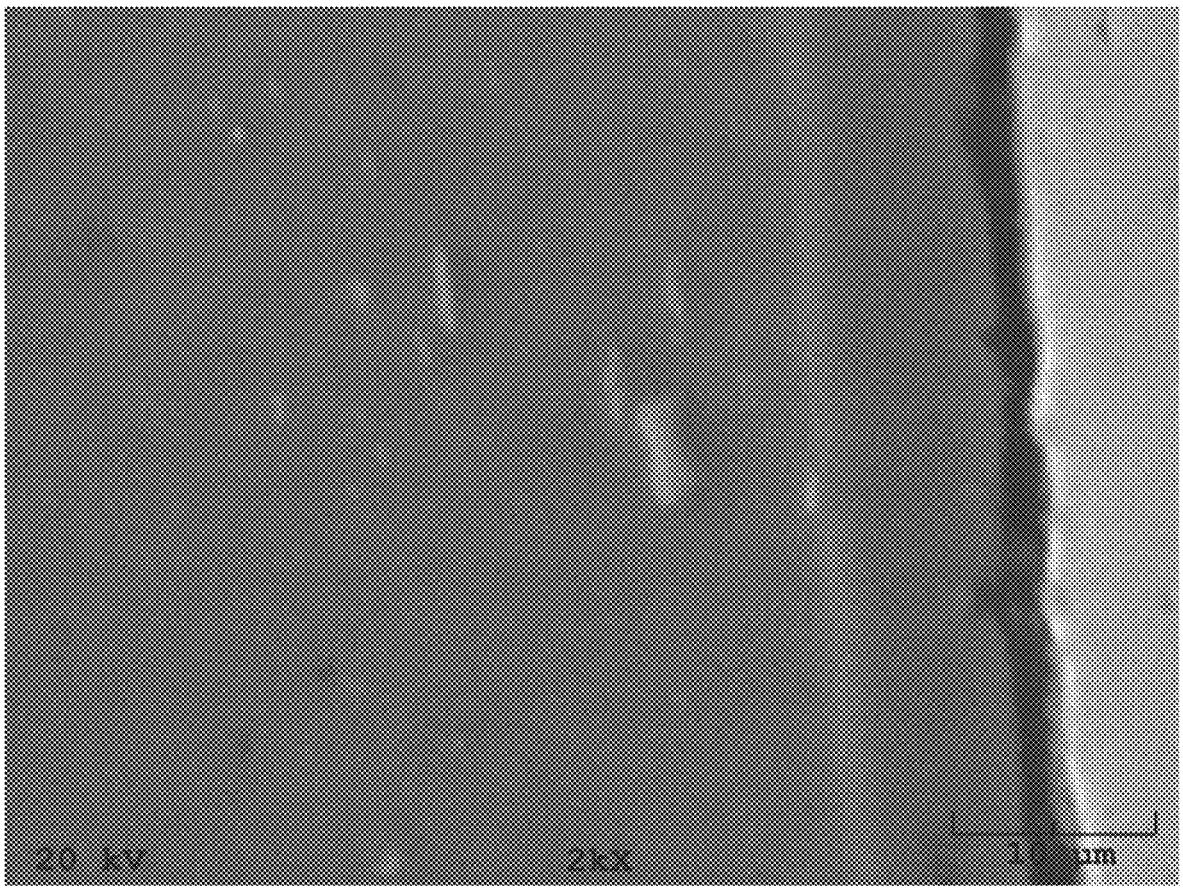
FIG. 20 is an SEM-EDS backscatter image of a cross section of specimen 11520149 (Sample 1). The materials in the image are in the following order from left to right: Aluminum Substrate; anodic coating; Bake-a-Lite; Stainless Steel Panel.
Figure 21:
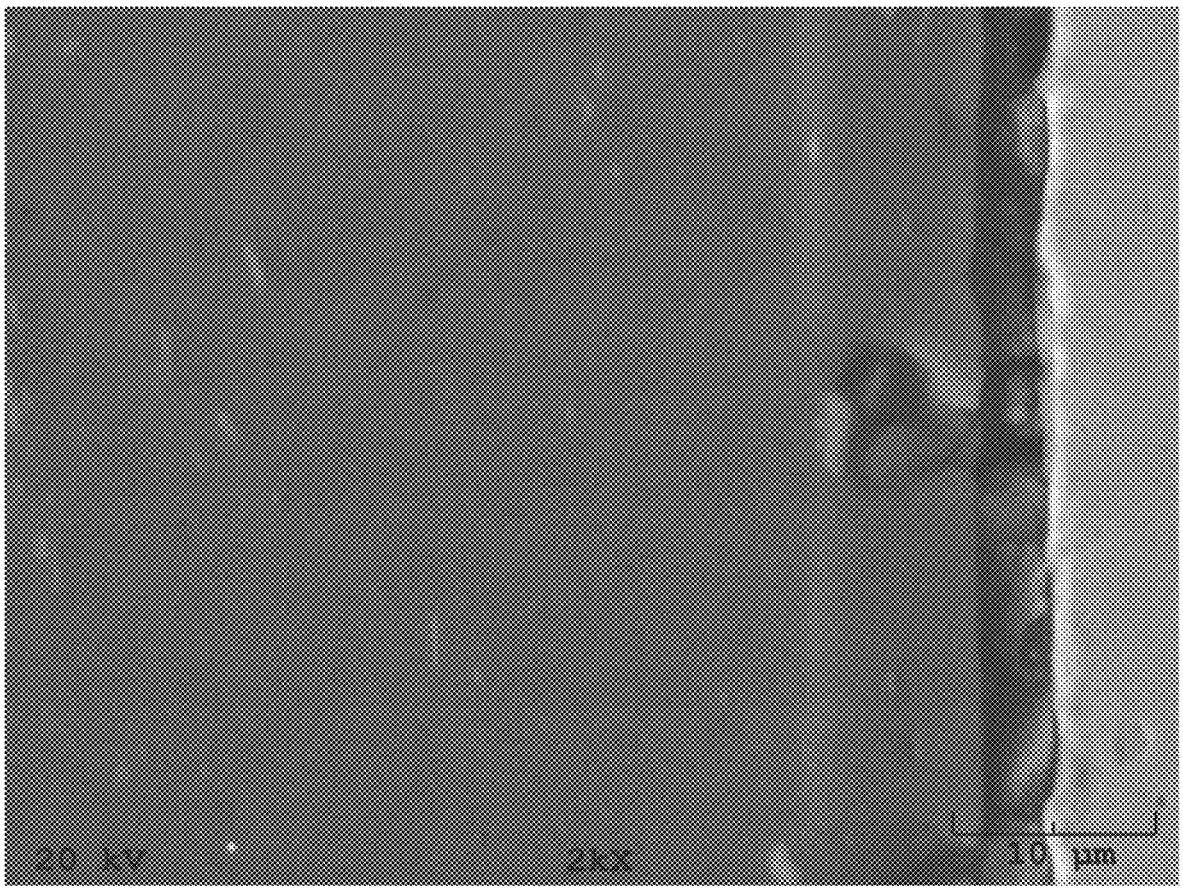
FIG. 21 is an SEM-EDS backscatter image of a cross section of specimen 11520149 (Sample 1). The materials in the image are in the following order from left to right: Aluminum Substrate; anodic coating; Bake-a-Lite; Stainless Steel Panel.

The topographical images and cross section showed significant differences from traditional anodic coatings. Void spaces were noticed in Sample 1. This was initially thought to be a pore formation, but subsequent analysis showed that this void space is formed from surface contamination on the surface of the aluminum prior to anodizing. The anodic coating was shown to form around the contamination but eventually removes the particulate from the surface and closes the space with aluminum oxide formation. The topographical image from Sample 1 illustrates the topographical surface condition of the anodized specimen. As shown in FIG. 19, there are sporadic void spaces that were initially thought to be pores but was subsequently determined to be a void space which developed in the location of previous surface contamination that was subsequently removed. The cross section images of FIGS. 20 and 21 illustrate evidence that the pore formation is significantly smaller than conventional anodic coatings.

Figure 22:
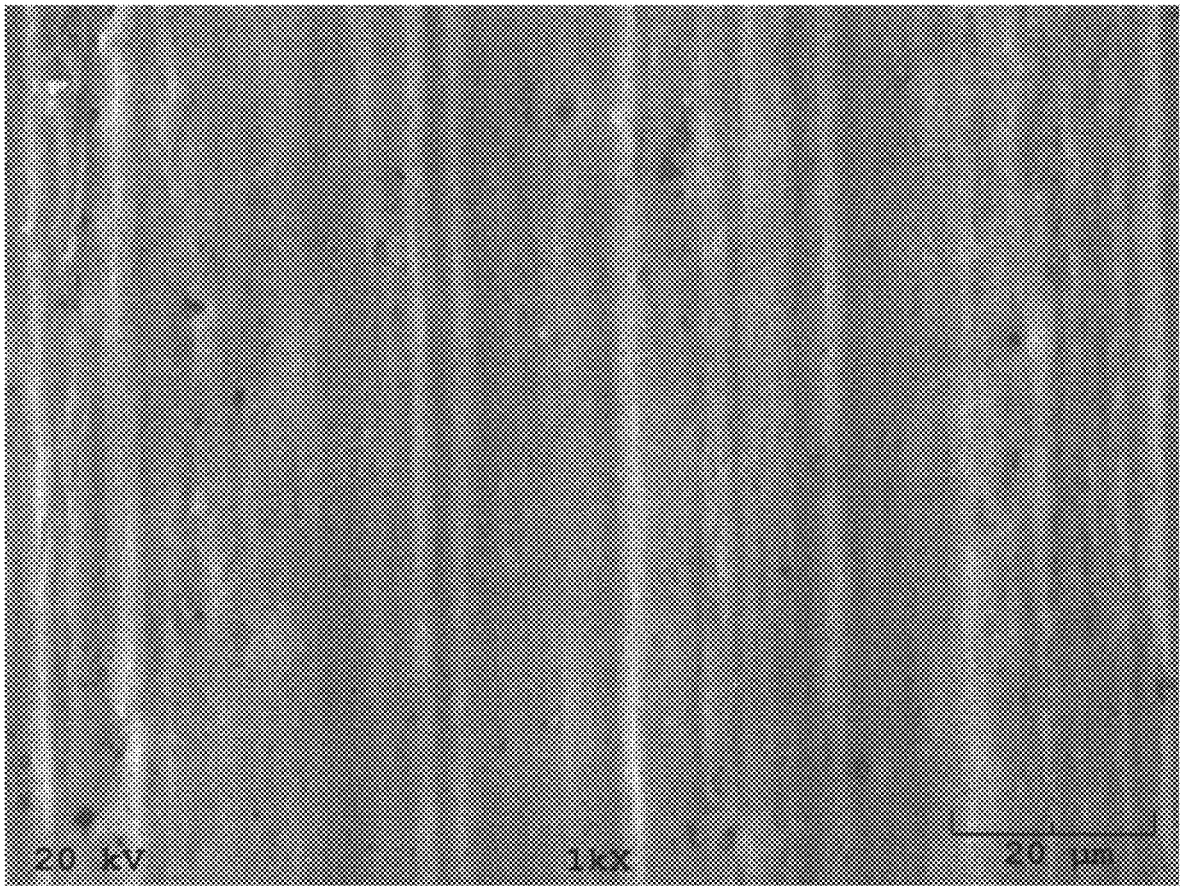
FIG. 22 is an SEM-EDS backscatter image of the surface of specimen 12820141 (Sample 2).
Figure 23:
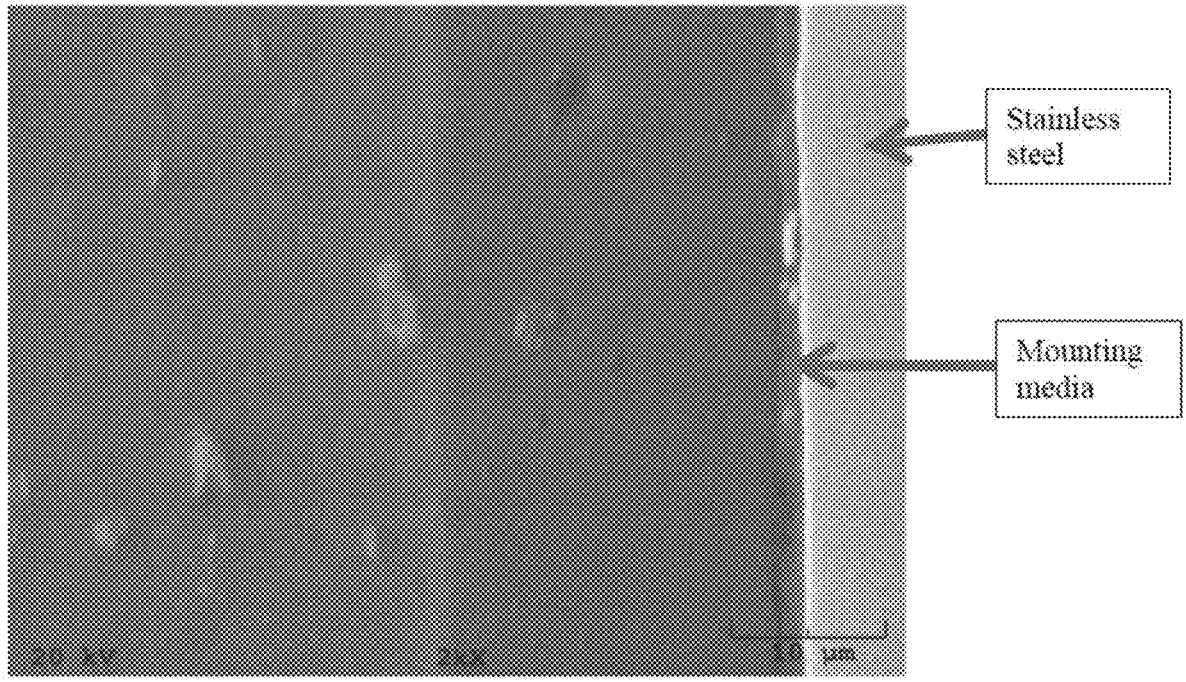
FIG. 23 is an SEM-EDS backscatter image of a cross section of specimen 12820141 (Sample 2). The materials in the image are in the following order from left to right: Aluminum Substrate; anodic coating; Bake-a-Lite; Stainless Steel Panel.
Figure 24:
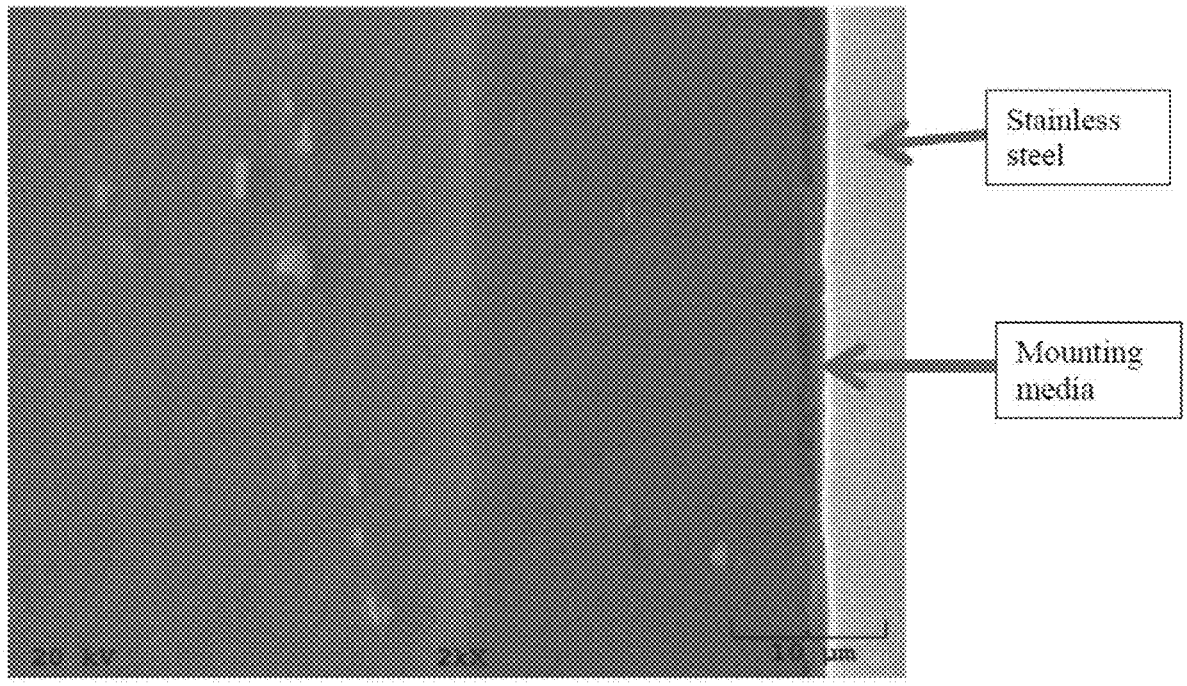
FIG. 24 is an SEM-EDS backscatter image of a cross section of specimen 12820141 (Sample 2). The materials in the image are in the following order from left to right: Aluminum Substrate; anodic coating; Bake-a-Lite; Stainless Steel Panel.

Sample 2 showed some signs of void spaces but there are far less spaces and they are significantly smaller. It can also be seen in Sample 2 that the void spaces, once the particulate is removed, fills with an aluminum oxide formation. The topographical image of FIG. 22 illustrates the void spaces become reduced in size and in quantity. The cross section images of FIGS. 23 and 24 verified that the void spaces become reduced in size and that the spaces subsequently become filled with an aluminum oxide formation once the contaminant is removed during the anodizing process.

For comparison, FIG. 25 represents a standard aluminum oxide coating that is currently being used in the industry today. As shown in the images, the current aluminum oxide coatings have a very porous nature (FIG. 25A). In the cross section image of FIG. 25B, the microfractures that cause a coating to be affected by corrosion are clearly shown. (Manish Sharma et al. Ferromagnetic Resonance—Theory and Applications, edited by Orhan Yalcin, Chapter 4—FMR Measurements of Magnetic Nanostructures, 2013) The SEM-EDS images of FIG. 25 are from the formation of nanowire arrays. In the nanowire array industry it is common practice to use oxalic acid or phosphoric acid as an electrolyte medium. These two acids are used due to either a wide pore diameter, a fast pore formation, or both. It is difficult to find SEM-EDS for sulfuric acid anodize because the industry where it is commonly applied does not have a necessity for an analysis of pore structure and morphology. The only time an SEM-EDS image would be used is in a failure analysis of high precision parts. However, from the coating weight analysis certain factors can be determined including the fact that with a higher coating weight at the same thickness, there is more aluminum oxide present, thus reducing the pore diameter dramatically.

FIG. 26A is a topographical SEM image and FIG. 26B is a cross sectional image of the novel anodic coating. As shown in the topographical view, there are no pores present. The small indents that were observed were locations where particulate contaminants were on the surface of the coating but were subsequently removed by the anodic process. The vertical pattern shown is the grain and machining pattern of the aluminum test specimen. As shown in the cross sectional image, the coating is smooth with no microfractures. The absence of pores and microfractures significantly enhances the durability of the coating beyond that shown in coatings that are produced by the conventional methods. Microfractures are one of the initial cause of fatigue in salt spray and taber abrasion analysis. Further, with a small pore diameter any stress applied to the coating is dispersed throughout the coating more evenly with no weak points.

Test specimens were anodized to 0.0003" and 0.0006" using the novel solution for analyzing ability of the coating to accept and retain dye pigmentation. It was unexpectedly found that the test specimen not only accepted and retained dye pigmentation when dyed immediately after the anodize process (industry standard), but one month after being anodized, the aluminum specimen were still able to accept and retain dye pigmentation just as efficiently as if they were processed by the industry standard practices.

Example 13

Organic Contamination Removal

In conducting the experiments on the novel anodizing solution described herein, it was found that permanganates are a strong oxidizer. Permanganates have the oxidizing potential to oxidize organic constituents and remove them from solution by gassing out the carbon as $CO_2$.

The inventors noted that at the beginning of the experiments, there was approximately 5% v/v of an organic electrolyte additive that was in the solution. Upon addition of the permanganate there was slight gassing and the solution would change in color from purple to clear with no electrical current to the solution. Once all of the organic electrolyte additive was oxidized out, the solution was used to anodize aluminum. After a significant amount of aluminum was anodized, the solution was tested and found to have a total dissolved solid concentration of 279 g/L, aluminum concentration of 4.5 g/L, manganese concentration of 4.5 g/L, and sulfuric acid concentration of 270 g/L (16% v/v of Technical Grade Sulfuric Acid with a density of 1660 g/cm$^3$). (results not shown)

Conventional anodizing solutions are unable to remove organic contaminants as shown by the electrolyte additive being organic in nature. Emulsion oils and other machining oils are organic in nature and conventional anodizing solutions are severely adversely affected by these oils. The removal of organic contaminants from the solution is beneficial because a reduced amount of contaminants in the solution results in a longer solution life and less chemical waste.

Example 14

Metal Removal

Through the duration of the trials, both large and medium scale, it was noticed that the solution would produce a significant amount of precipitate. This precipitate was analyzed and the inventors concluded that the precipitate was a mixture of aluminum oxide, copper oxide, zinc oxide and iron oxide. These metal contaminants form in solution by a combination of the cathode dissolving and aluminum from the anode being transferred into solution and subsequently being oxidized by the permanganate. The above listed metal contaminants were the three most commonly observed in the experiments which is likely due to the copper, aluminum, and zinc contents of the test specimen and cathode material, as well as the iron from surrounding equipment contaminating the solution. The metals that permanganate has the capabilities to oxidize and precipitate out of solution include, but not limited to, aluminum, zinc, copper, iron, and magnesium.

The removal of metal contaminants from solution is beneficial because, similarly to the removal of organic contaminants described above, a reduced amount of metal contaminants in the solution results in a longer solution life and less chemical waste. Almost all metals found in aluminum alloys are soluble at a pH less than 2.3. With sulfuric acid at a concentration greater than 0.1% w/v in conventional anodizing, the pH of the solution is less than a pH of 1, and thus conventional anodizing does not allow for metal precipitation to occur. At an extremely low pH other chemical forces are required to cause metal precipitation. With the high oxidative capabilities of permanganate coupled with the applied voltage, the novel solution has the ability to precipitate out metals without adversely affecting the anodizing solution.

Example 15

Cleaning and Activation of Aluminum

One of the new uses for the novel composition described herein is a method of cleaning and activating aluminum for plating. The inventors have found that the novel solution described herein has the ability to remove emulsion oils and surface contamination from machined aluminum by immersion with no applied voltage for a duration of about one to five minutes. This cleaning affectively removed the surface oils and sufficiently prepared the aluminum specimen for further processes. (results not shown)

It was found that the novel solution (10% w/v sulfuric acid, 0.06% w/v potassium permanganate) can degrease, etch, and de-smut aluminum specimen by adjusting the temperature of the solution. At temperatures of about 70-80° F. the solution acts as a degreaser and removes emulsion oils and machining oils. At about 90-110° F. the solution is able to etch the specimen and remove a small amount of the surface material to expose bare aluminum. At 50-65° F. the solution is capable of de-smutting the specimen of the residue that is left on the specimen from the etching process.

Using the same solution used in the cleaning process described above, a sample was placed in an Electroless Nickel Plating solution composed of about 6 g/L of nickel metal from Nickel sulfate and about 30 g/L of hypophophite from proprietary mixtures. A nickel-phosphorous coating was formed after immersion for about 15 minutes. This coating was analyzed for adhesion and the specimen passed with excellent adhesion. (results not shown)

The current cleaning and activation of aluminum for plating uses highly toxic chemicals, is a very sensitive process, and there is a high degree of cross contamination of process solutions. The general steps in the activation of aluminum involve a double-zincate process where the specimen is cleaned and a zincate coating is applied. This coating is then stripped off in diluted nitric acid and re-applied. The specimen is then rinsed and placed into the plating solutions. The zincate component of the solution is detrimental when introduced into other plating solutions and can result in test failures of subsequently plated parts. The use of the novel permanganate solution described herein for the cleaning and activation of aluminum is safer, easier, and more effective than the conventional method.

Example 16

Black Nickel-Phosphorous Coating

Another new use for the novel permanganate solution described herein is the formation of Black Electroless Nickel coating. Industry practices for the production of a "Black Electroless Nickel" coating consist of producing a Nickel-Phosphorous coating with a phosphorous content of 5-12% to the desired thickness, then putting a topcoat of a Nickel-Phosphorous coating with a Phosphorous content of 1-2% on and then immersion in a solution to produce a "Black Nickel" coating. This coating, once baked for hardness, has a hardness close to that of hard chrome plating, but the process is time consuming and costly.

"Black Electroless Nickel" is produced by the oxidation of the nickel in the Nickel-Phosphorous coating. With a coating above a phosphorous content of 5%, the current solutions are unable to produce the Nickel Oxide formation.

The inventors found that the novel solution described herein can also oxidize nickel to form a nickel oxide coating on Nickel-Phosphorous coatings with a Phosphorous content of 5-12%. A nickel oxide coating was produced from a Nickel-Phosphorous coating with a phosphorous content of 8%.

Materials and Methods

Four (4) 1"×4" panels were plated with a Mid-Phosphorous Electroless Nickel Coating consisting of 5-10% Phosphorous. The panels were one of each of the following material: Steel, Copper, Brass, and Aluminum. Each Panel was plated to a thickness of about 0.0005-0.0006 inches.

The panels were then placed into a solution containing 10% v/v sulfuric acid (ACS Reagent Grade) and 0.6 g/L, 0.06% w/v, of potassium permanganate. The panels were immersed in solution for a time of between about 10-600 seconds (with an average of 45-60 seconds). All panels, once dried, presented a smooth, uniform, and jet black appearance comparable to the appearance obtained using the conventional methods. (results not shown)

The formation of a black electroless nickel using the novel composition described herein is both a faster and more cost effective means of forming black electroless nickel on a variety of substrates.

Example 17

Formation of Bright Nickel Coating

A further novel use for the novel solution described herein is the formation of bright nickel coatings. Bright nickel coatings are produced in solutions with proprietary brightening components added to the solution. These components require frequent replenishment and are very costly.

An aluminum test specimen was plated with nickel from a nickel chloride plating solution that was composed of nickel chloride at about 209-262 g/L and hydrochloric acid concentration at about 414-591 mL/L. The specimen's appearance after the application of the nickel coating was dull and non-reflective. The specimen was then subsequently plated with zinc from a cyanide zinc plating solution composed of zinc metal at about 7.5-15 g/L, sodium cyanide at about 7.5-537.5 g/L, sodium hydroxide at about 67.5-112.5 g/L, and sodium carbonate at less than about 90 g/L. These amounts are exemplary and any conventional nickel plating solution would work.

The panel was then placed in the novel solution composed of about 10% w/v sulfuric acid and about 0.6 g/L, 0.06% w/v, potassium permanganate. When the panel was removed, it was found that the zinc coating was removed and the nickel coating, which started out dull, was extremely bright and lustrous. While this example was conducted on aluminum, several other metals may be used as the substrate including, but not limited to, zinc, copper, brass and steel.

It was found that subsequent zinc plating is critical in the formation of the lustrous appearance of the nickel coating due to the formation of a crystalline lattice structure of the nickel coating to allow ease of electron flow in the subsequent plating process. Zinc is used due to its ability to readily oxidize off. This nickel coating did not form nickel oxide due to the steric hindrance of the pure nickel coating and the absence of phosphorous. This is beneficial in that the lustrous appearance is appealing to customers and also is a critical component in subsequent gold plating.

CONCLUSION

The novel anodizing process and solution described herein simplifies all three different processes of anodizing aluminum into one tank. The ability to minimize dimensional change allows metal fabricators to machine the specimen to the desired final specifications thus eliminating operator error in the metal finishing process. The operators can anodize into the specimen as deep as required to obtain the necessary functional properties including wear and corrosion resistance.

In addition, potassium permanganate is environmentally safe and has been used as a water treatment chemical to eliminate iron and other organic hazardous substance by either gassing off of organic matter or precipitation from solution via metal oxides. It is also used as a disinfectant and has various other treatment capabilities.

A by-product reaction of the novel process described herein is that the dissolved metal contaminants that buildup in solution precipitates out of solution. This leads to less contamination in the tank and a longer solution life. The implementation of this process has a significant industrial impact including cleaning, anodizing, dying, sealing, and disposal.

In addition to the method of anodizing, the inventors have also discovered several novel uses for the permanganate solution described herein including removal of organic and metal contaminants from a solution, cleaning and activation of aluminum for plating, formation of black electroless nickel, and formation of a bright nickel coating.

The disclosures of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall there between. Now that the invention has been described,

What is claimed is:

1. An anodizing system for use in anodizing of aluminum, magnesium or alloys thereof comprising:

a metal substrate wherein the metal substrate is aluminum, magnesium or alloy thereof; and an anodizing solution comprising:

an acid solution formed from at least one acid selected from the group consisting of sulfuric acid, nitric acid, phosphoric acid, hydrochloric acid, citric acid, boric acid, carboxylic acid, carbonic acid and combinations thereof diluted with deionized water; and at least one oxidizing agent selected from the group consisting of potassium permanganate, sodium permanganate, hydrogen permanganate, lithium permanganate, sodium orthovanadate and combinations thereof;

wherein the at least one acid is present in the anodizing solution at a concentration of between about 10% w/v to about 20% w/v;

wherein the at least one oxidizing agent is present in the anodizing solution at a concentration of between about 0.01% w/v to about 0.05% w/v.

2. The system of claim 1, further comprising phosphoric acid.

3. The system of claim 1, wherein the acid is sulfuric acid.

4. The system of claim 2, wherein the phosphoric acid is present in the solution at a concentration of about 0.04% w/v.

5. The system of claim 1, wherein the oxidizing agent is potassium permanganate.

* * * * *